US010621921B2

(12) United States Patent
Song

(10) Patent No.: US 10,621,921 B2
(45) **Date of Patent: *Apr. 14, 2020**

(54) ORGANIC LIGHT EMITTING DIODE DISPLAY DEVICE AND METHOD FOR OPERATING THE SAME

(71) Applicant: LG ELECTRONICS INC., Seoul (KR)

(72) Inventor: Woojung Song, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/538,133

(22) Filed: Aug. 12, 2019

(65) Prior Publication Data

US 2019/0362676 A1 Nov. 28, 2019

Related U.S. Application Data

(63) Continuation of application No. 15/860,975, filed on Jan. 3, 2018, now Pat. No. 10,424,251.

(30) Foreign Application Priority Data

Sep. 29, 2017 (KR) ..... 10-2017-0127703

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2310/0264* (2013.01); *G09G 2320/0257* (2013.01); *G09G 2330/027* (2013.01)

(58) Field of Classification Search
None
See application file for complete search history.

(56) References Cited

U.S. PATENT DOCUMENTS

| | | | | |
|---|---|---|---|---|
| 10,152,916 | B2 * | 12/2018 | Wang | G09G 3/2003 |
| 2008/0303775 | A1 | 12/2008 | Guo et al. | |
| 2009/0251391 | A1 | 10/2009 | Ng | |
| 2014/0092144 | A1 | 4/2014 | Kim | |
| 2014/0184482 | A1 | 7/2014 | Zhang | |

(Continued)

FOREIGN PATENT DOCUMENTS

| | | |
|---|---|---|
| EP | 3 065 277 | 9/2016 |

OTHER PUBLICATIONS

Partial European Search Report dated Dec. 20, 2018 issued in Application No. 18196499.0.

(Continued)

*Primary Examiner* — Duane N Taylor, Jr.
(74) *Attorney, Agent, or Firm* — Ked & Associates, LLP

(57) ABSTRACT

An organic light emitting diode display device includes a display unit including pixels each configured by an organic light emitting diode, a power supply unit configured to supply power for driving the display unit, a discharge unit connected to the display unit and configured to perform a discharge operation on a display driving voltage applied to the display unit, and a discharge control unit configured to control enabling and disabling of the discharge unit based on a power state of the organic light emitting diode display device.

20 Claims, 17 Drawing Sheets

(56) References Cited

U.S. PATENT DOCUMENTS

| | | | |
|---|---|---|---|
| 2015/0243213 | A1 | 8/2015 | Ryu |
| 2016/0180770 | A1 | 6/2016 | Duan |
| 2016/0189624 | A1 | 6/2016 | Jang |
| 2016/0260382 | A1 | 9/2016 | Choi |
| 2016/0275859 | A1 | 9/2016 | Tseng |

OTHER PUBLICATIONS

U.S. Notice of Allowance dated May 23, 2019 issued in related U.S. Appl. No. 15/860,975.

* cited by examiner

HIL : Hole Injection Layer
HTL : Hole Transfer Layer
EML : Emitting Layer
ETL : Electron Transfer Layer

ORGANIC LIGHT EMITTING DIODE DISPLAY DEVICE AND METHOD FOR OPERATING THE SAME

CROSS-REFERENCE TO RELATED APPLICATION(S)

This application is a Continuation Application of U.S. patent application Ser. No. 15/860,975, filed Jan. 3, 2018, which claims priority under 35 U.S.C. 119 and 35 U.S.C. 365 to Korean Patent Application No. 10-2017-0127703 (filed in Korea on Sep. 29, 2017), which is hereby incorporated by reference in its entirety.

BACKGROUND

1. Field

The present invention relates to a display device, and more particularly, to an organic light emitting diode (OLED) display device having pixels each configured by an OLED, and a method for operating the same.

2. Background

Recently, as the use of various smart devices and high-resolution large screens as well as televisions has increased, the types of display devices have been diversified. In particular, a variety of flat panel displays (FPDs) have been developed which can further reduce the weight and volume than a so-called cathode ray tube (CRT). Specifically, flat panel displays, such as liquid crystal displays (LCDs), thin film transistor-liquid crystal displays (TFT-LCDs), plasma display panels (PDPs), and electroluminescence devices have attracted attention.

The electroluminescence devices may be classified into an inorganic light emitting diode and an organic light emitting diode (OLED) according to a material of an emitting layer. The OLED is a self-luminous organic material that emits light by itself by using an electroluminescence phenomenon that light is emitted when a current flows through a fluorescent organic compound. The OLED can be driven at a low voltage and can be made light and thin. Additionally, since each device is a luminous type that emits light, light is adjusted by changing a current flowing through each device. Thus, a backlight is not required. An OLED display device implemented with such OLEDs has advantages such as a fast response time, high image quality, high luminescent efficiency, an ultra-thin structure, and a wide viewing angle.

Due to the above advantages, the prospect of the OLED display device is bright, and the demand for the OLED display device is increasing.

On the other hand, when the power of the OLED display device is turned off, the supply of power to a display unit including an OLED element may be interrupted. Even when the supply of power is interrupted, a voltage may be generated between a power supply unit and a display unit by residual current, and the voltage may be lowered with the passage of time by a discharge phenomenon. The OLED element provided in the display device may emit light when a voltage of a predetermined level (for example, about 5 V) or more is supplied thereto. That is, if the power of the display device is turned on again before the voltage between the power supply unit and the display unit is sufficiently discharged, noise or afterimage may be generated by the light emission of the OLED element.

In order to solve this problem, the display device may drive the display unit by turning on power after the voltage between the power supply unit and the display unit is sufficiently discharged to a predetermined value or less. However, in this case, since the time when the power of the display device is turned on may be delayed, a user may feel inconvenience in using the display device and may not be satisfied with the performance of the product.

BRIEF DESCRIPTION OF THE DRAWINGS

Embodiments will be described in detail with reference to the following drawings in which like reference numerals refer to like elements, and wherein:

FIG. 14 is a flowchart for describing an operation when the power of the OLED display device is turned on;

DETAILED DESCRIPTION

Hereinafter, embodiments relating to the present invention will be described in detail with reference to the accompanying drawings. The suffixes "module" and "unit" for components used in the description below are assigned or mixed in consideration of easiness in writing the specification and do not have distinctive meanings or roles by themselves.

A display device according to an embodiment of the present invention, for example, as an intelligent display device that adds a computer supporting function to a broadcast receiving function, can have an easy-to-use interface such as a writing input device, a touch screen, or a spatial remote control device as an internet function is added while fulfilling the broadcast receiving function. Then, with the support of a wired or wireless internet function, it is possible to perform an e-mail, web browsing, banking, or game function in access to internet and computers. In order for such various functions, standardized general purpose OS can be used.

Accordingly, since various applications are freely added or deleted on a general purpose OS kernel, a display device described in this present invention, for example, can perform various user-friendly functions. The display device, in more detail, can be network TV, HBBTV, smart TV, LED TV, OLED TV, and so on and in some cases, can be applied to a smartphone.

Figure 1:
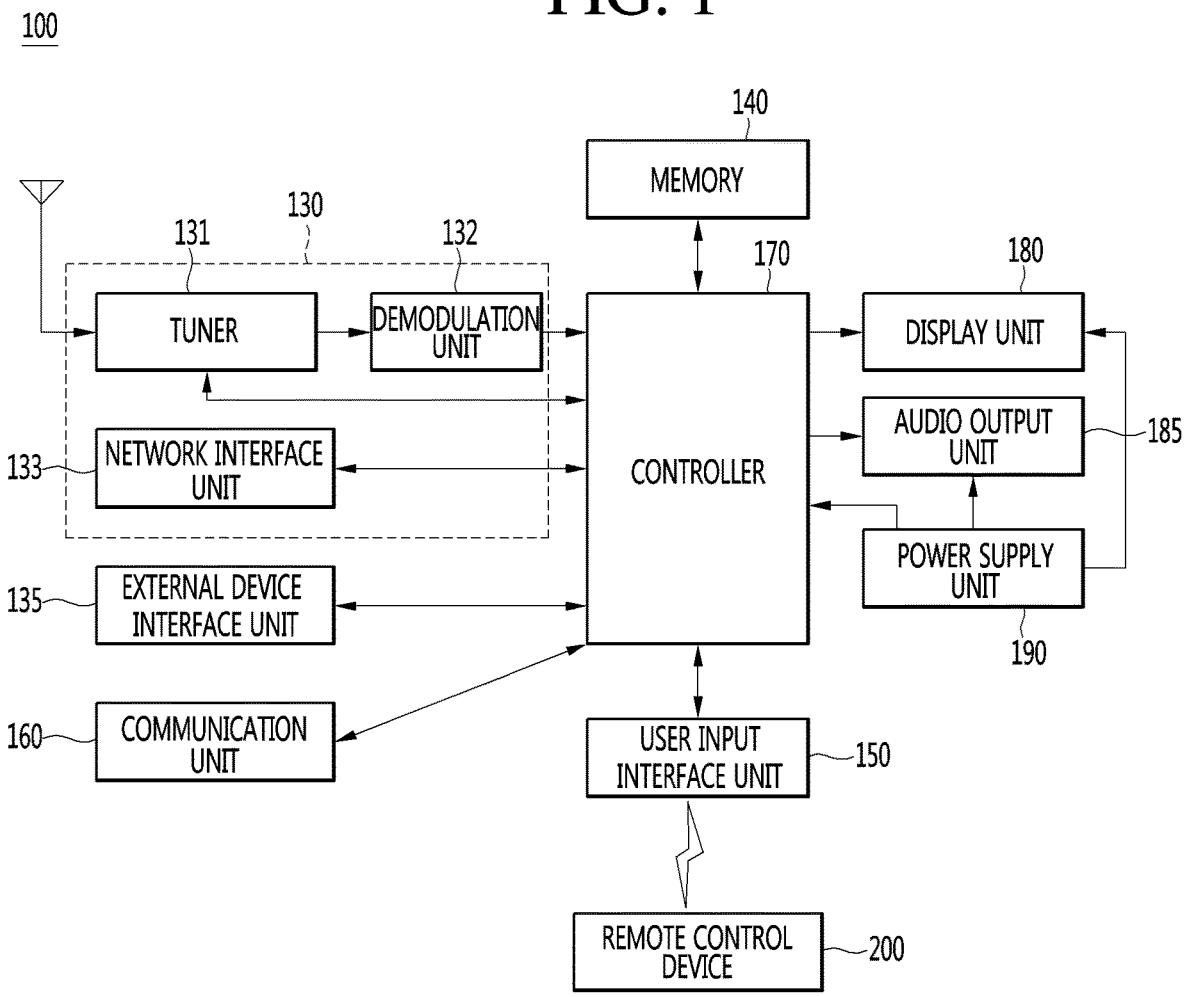
FIG. 1 is a block diagram illustrating a configuration of a display device according to an embodiment of the present invention.

FIG. 1 is a block diagram illustrating a configuration of a display device according to an embodiment of the present invention.

Referring to FIG. 1, the display device 100 may include a broadcast reception unit 130, an external device interface unit 135, a memory 140, a user input interface unit 150, a controller 170, a short-range communication unit 173, a display unit 180 (display or display panel), an audio output unit 185, and a power supply unit 190.

The broadcast reception unit 130 may include a tuner 131, a demodulation unit 132, and a network interface unit 133.

The tuner 131 may select a specific broadcast channel according to a channel selection command. The tuner 131 may receive broadcast signals for the selected specific broadcast channel.

The demodulation unit 132 may divide the received broadcast signals into video signals, audio signals, and broadcast program related data signals and restore the divided video signals, audio signals, and data signals to an output available form.

The external device interface unit 135 may receive an application or an application list of an adjacent external device and transfer the application or the application list to the controller 170 or the memory 140.

The external device interface unit 135 may provide a connection path between the display device 100 and the external device. The external device interface unit 135 may receive an image and/or an audio outputted from the external device and transfers the image and/or the audio to the controller 170. The external device connectable to the external device interface unit 135 may be one of a set-top box, a Blu-ray player, a DVD player, a game console, a sound bar, a smartphone, a PC, a USB memory, and a home theater system.

The network interface unit 133 may provide an interface for connecting the display device 100 to a wired/wireless network including an Internet network. The network interface unit 133 may transmit or receive data to or from another user or another electronic device through an accessed network or another network linked to the accessed network.

Additionally, the network interface unit 133 may transmit a part of content data stored in the display device 100 to a user or an electronic device selected from other users or other electronic devices preregistered in the display device 100.

The network interface unit 133 may access a predetermined webpage through the accessed network or another network linked to the accessed network. That is, the network interface unit 133 may access the predetermined webpage through the network and transmit or receive data to or from a corresponding server.

The network interface unit 133 may receive content or data provided by a content provider or a network operator. That is, the network interface unit 133 may receive content (e.g., movies, advertisements, games, VOD, broadcast signals, etc.) and content-related information provided from the content provider or the network operator through the network.

Additionally, the network interface unit 133 may receive update information and update files of firmware provided by the network operator and may transmit data to the Internet or content provider or the network operator.

The network interface unit 133 may select and receive a desired application among applications, which are open to the public, through the network.

The memory 140 may store a program for signal processing and control in the controller 170 and may store signal-processed image, voice, or data signals.

Additionally, the memory 140 may perform a function for temporarily storing image, voice, or data signals inputted from the external device interface unit 135 or the network interface unit 133 and may store information on a predetermined image through a channel memory function.

The memory 140 may store an application or an application list inputted from the external device interface unit 135 or the network interface unit 133.

The display device 100 may reproduce content files (e.g., moving image files, still image files, music files, document files, application files, etc.) stored in the memory 140 so as to provide the content files to the user.

The user input interface unit 150 may transfer signals inputted by the user to the controller 170 or may transfer signals from the controller 170 to the user. For example, the user input interface unit 150 may receive and process control signals such as power on/off, channel selection, or screen setup from the remote control device 200 or may transmit control signals from the controller 170 to a remote control device 200, according to various communication methods such as Bluetooth, Ultra Wideband (WB), ZigBee, Radio Frequency (RF) communication scheme, or infrared (IR) communication scheme.

Additionally, the user input interface unit 150 may transfer, to the controller 170, control signals inputted from local keys (not shown) such as a power key, a channel key, a volume key, and a setting key.

Image signals that are image-processed by the controller 170 may be inputted to the display unit 180 and displayed as an image corresponding to the image signals. Additionally, image signals that are image-processed by the controller 170 may be inputted to an external output device through the external device interface unit 135.

Voice signals that are processed by the controller 170 may be outputted as audio to the audio output unit 185. Additionally, image signals that are processed by the controller 170 may be inputted to an external output device through the external device interface unit 135.

In addition, the controller 170 may control an overall operation of the display device 100.

Additionally, the controller 170 may control the display device 100 by a user command inputted through the user input interface unit 150 or an internal program and may connect to the network to download an application or an application list desired by the user into the display device 100.

The controller 170 may output channel information selected by the user through the display unit 180 or the audio output unit 185 together with the processed image or voice signals.

Additionally, the controller 170 may output the image signal or the voice signal, which is inputted from the external device (e.g., a camera or a camcorder) through the external device interface unit 135, to the display unit 180 or the audio output unit 185 according to an external device image reproduction command received through the user input interface unit 150.

On the other hand, the controller 170 may control the display unit 180 to display images. For example, the controller 170 may control the display unit 180 to display broadcast images inputted through the tuner 131, external input images inputted through the external device interface unit 135, images inputted through the network interface unit, or images stored in the memory 140. In this case, an image displayed on the display unit 180 may be a still image or video, and may be a 2D image or a 3D image.

Additionally, the controller 170 may perform control to reproduce content stored in the display device 100, received broadcast content, or external input content inputted from the outside. The content may be various types, such as a broadcast image, an external input image, an audio file, a still image, a connected web screen, a document file, and the like The short-range communication unit 173 may perform a wired or wireless communication with an external device. The short-range communication unit 173 may perform short-range communication with an external device. To this end, the short-range communication unit 173 can support short-range communication by using at least one of Bluetooth™, Radio Frequency Identification (RFID), Infrared Data Association (IrDA), Ultra Wideband (UWB), ZigBee, Near Field Communication (NFC), Wireless-Fidelity (Wi-Fi), Wi-Fi Direct, and Wireless Universal Serial Bus (USB) technologies. The short-range communication unit 173 may support wireless communication between the display device 100 and a wireless communication system, between the display device 100 and another display device 100, or between networks including the display device 100 and another display device 100 (or an external server) through wireless area networks. The wireless area networks may be wireless personal area networks.

Herein, the other display device 100 may be a mobile terminal such as a wearable device (for example, a smart watch, a smart glass, and a head mounted display (HMD)) or a smartphone, which is capable of exchanging data (or interworking) with the display device 100. The short-range communication unit 173 can detect (or recognize) a communicable wearable device around the display device 100. Furthermore, if the detected wearable device is a device authenticated to communicate with the display device 100 according to the present invention, the controller 170 may transmit at least part of data processed by the display device 100 to the wearable device through the short-range communication unit 173. Accordingly, a user of the wearable device may use the data processed by the display device 100 through the wearable device.

The display unit 180 may generate a driving signal (drive signal) by converting an image signal, a data signal, or an OSD signal, which is processed by the controller 170, or an image signal or a data signal, which is received by the external device interface unit 135, into R, G, and B signals.

On the other hand, the display device 100 shown in FIG. 1 is merely one embodiment of the present invention, and some of the illustrated elements may be integrated, added, or omitted according to the specification of the display device 100 to be actually implemented.

That is, if necessary, two or more elements may be integrated into one element, or one element may be divided into two or more elements. Additionally, the function performed by each block is provided for describing the embodiments of the present disclosure, and a specific operation or device thereof does not limit the scope of the present disclosure.

According to another embodiment of the present invention, the display device 100 may not include the tuner 131 and the demodulation unit 132, unlike that shown in FIG. 1, and may receive an image through the network interface unit 133 or the external device interface unit 135 and reproduce the received image.

For example, the display device 100 may be divided into an image processing device such as a set-top box for receiving a broadcast signal or content provided by various network services, and a content reproduction device for reproducing content inputted from the image processing device.

In this case, an operating method of the display device according to an embodiment of the present invention, which will be described below, may be performed by the display device 100 described above with reference to FIG. 1, or may be performed by any one of the image processing device such as the set-top box and the content reproduction device including the display unit 180 and the audio output unit 185.

Next, the remote control device according to an embodiment of the present invention will be described with reference to FIGS. 2 and 3.

Figure 2:
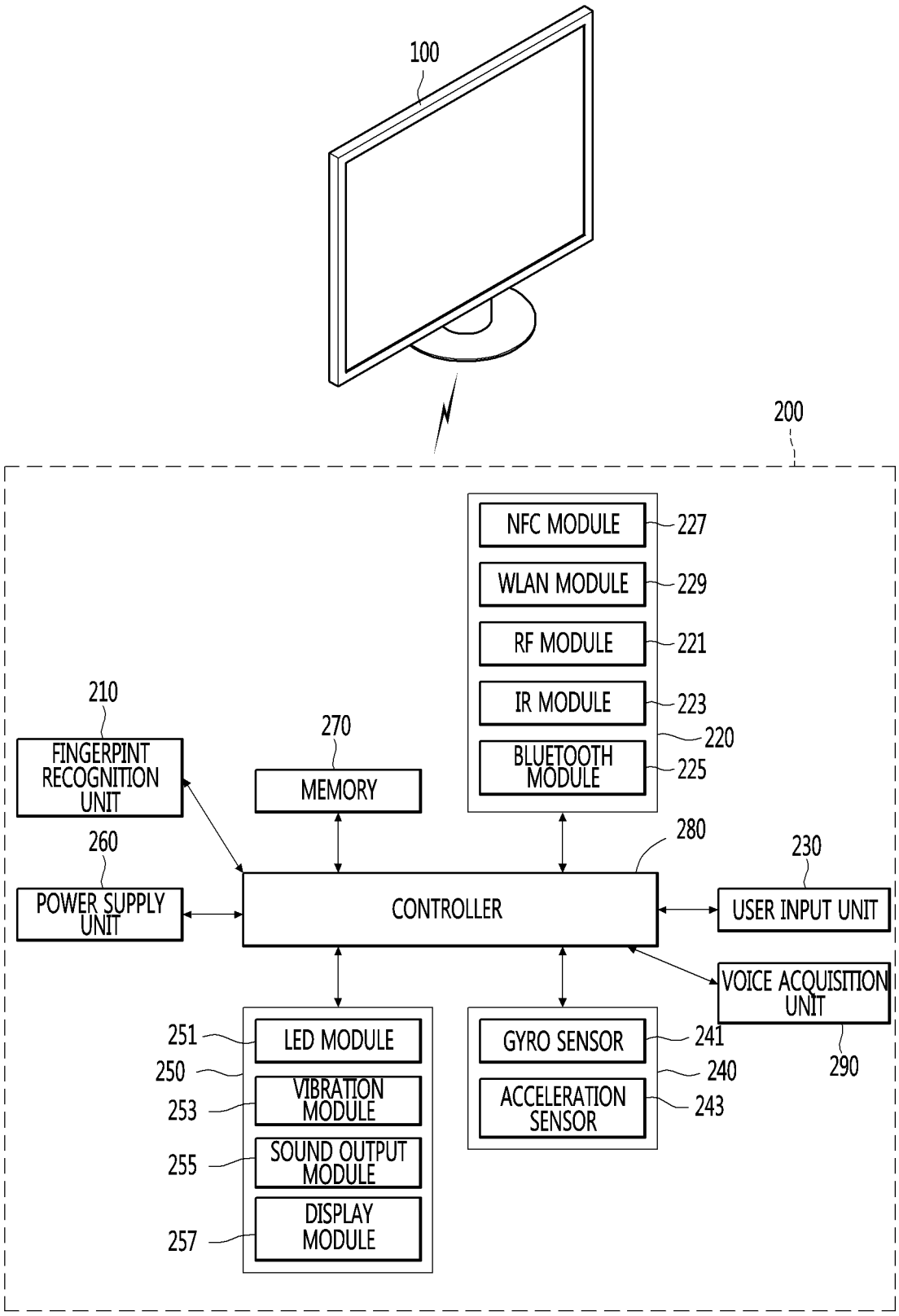
FIG. 2 is a block diagram illustrating a remote control device according to an embodiment of the present invention.
Figure 3:
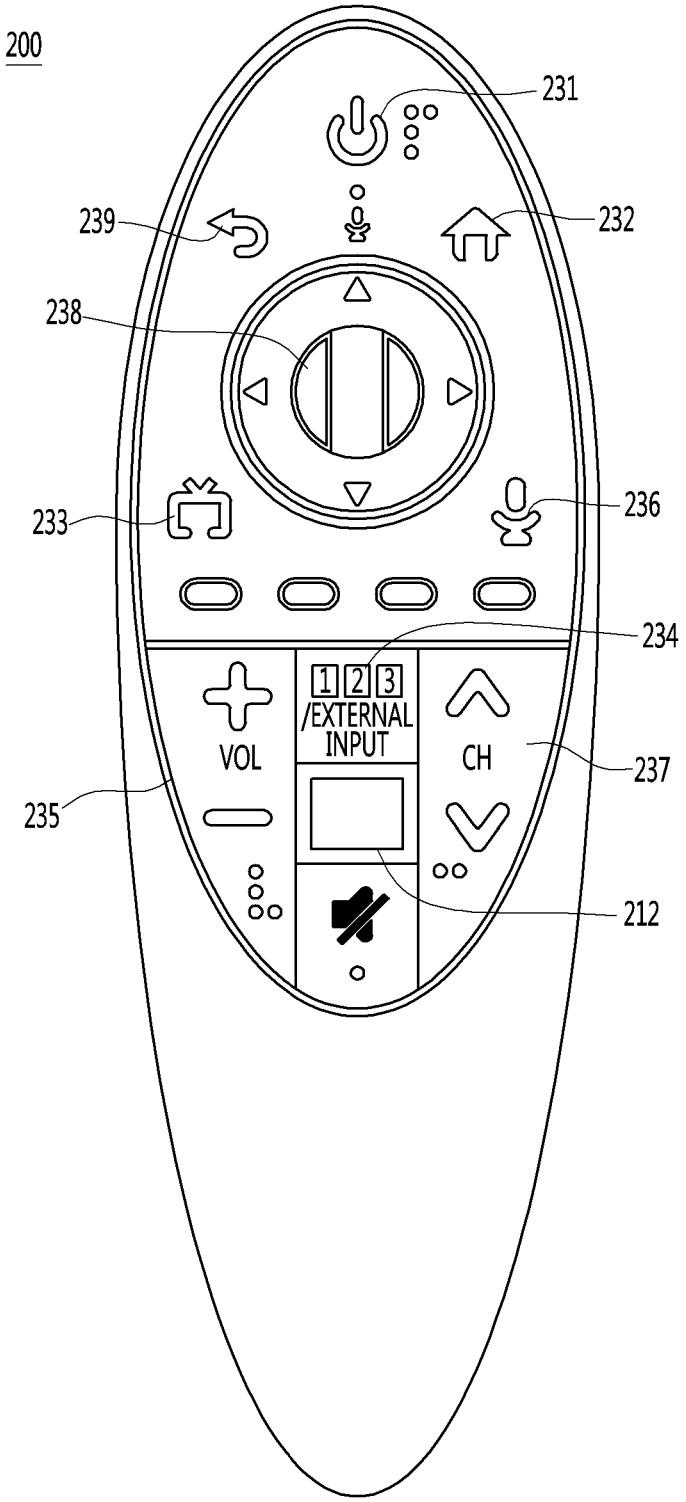
FIG. 3 is a view illustrating an actual configuration of a remote control device according to an embodiment of the present invention.

FIG. 2 is a block diagram of the remote control device 200 according to an embodiment of the present invention, and FIG. 3 illustrates an actual configuration example of the remote control device 200 according to an embodiment of the present disclosure.

First, referring to FIG. 2, the remote control device 200 may include a fingerprint recognition unit 210, a wireless communication unit 220, a user input unit 230, a sensor unit 240, an output unit 250, a power supply unit 260, a memory 270, a controller 280, and a voice acquisition unit 290.

Referring to FIG. 2, the wireless communication unit 220 transmits and receives a signal to and from any one of the display devices according to the aforementioned embodiments of the present invention.

The remote control device 200 may include an RF module 221 configured to transmit and receive a signal to and from the display device 100 according to an RF communication standard, and an IR module 223 configured to transmit and receive a signal to and from the display device 100 according to an IR communication standard. Additionally, the remote control device 200 may include a Bluetooth module 225 configured to transmit and receive a signal to and from the display device 100 according to a Bluetooth communication standard. Additionally, the remote control device 200 may include a Near Field Communication (NFC) module 227 configured to transmit and receive a signal to and from the display device 100 according to an NFC communication standard, and a Wireless LAN (WLAN) module 229 configured to transmit and receive a signal to and from the display device 100 according to a WLAN communication standard.

Additionally, the remote control device 200 may transmit signals containing information on a movement of the remote control device 200 to the display device 100 through the wireless communication unit 220.

On the other hand, the remote control device 200 may receive a signal transmitted by the display device 100 through the RF module 221 and, if necessary, may transmit a command for power on/off, channel change, volume change, or the like to the display device 100 through the IR module 223.

The user input unit 230 may include a keypad, a button, a touch pad, or a touch screen. The user may operate the user input unit 230 to input a command associated with the display device 100 to the remote control device 200. When the user input unit 230 includes a hard key button, the user may push the hard key button to input a command associated with the display device 100 to the remote control device 200. This will be described below with reference to FIG. 3.

Referring to FIG. 3, the remote control device 200 may include a plurality of buttons. The plurality of buttons may include a fingerprint recognition button 212, a power button 231, a home button 232, a live button 233, an external input button 234, a volume control button 235, a voice recognition button 236, a channel change button 237, a check button 238, and a back button 239.

The fingerprint recognition button 212 may be a button for recognizing a user's fingerprint. According to an embodiment, the fingerprint recognition button 212 may perform a push operation and receive a push operation and a fingerprint recognition operation. The power button 231 may be a button for turning on or off the power of the display device 100. The home button 232 may be a button for moving to a home screen of the display device 100. The live button 233 may be a button for displaying a broadcast program in real time. The external input button 234 may be a button for receiving an external input connected to the display device 100. The volume control button 235 may be a button for adjusting a volume outputted from the display device 100. The voice recognition button 236 may be a button for receiving a voice of a user and recognizing the received voice. The channel change button 237 may be a button for receiving a broadcast signal of a specific broadcast channel. The check button 238 may be a button for selecting a specific function, and the back button 239 may be a button for returning to a previous screen.

Again, FIG. 2 is described.

If the user input unit 230 includes a touch screen, a user can touch a soft key of the touch screen to input a command associated with the display device 100 to the remote control device 200. Additionally, the user input unit 230 may include various types of input units operated by a user, for example, a scroll key or a jog key, and this embodiment does not limit the scope of the present invention.

The sensor unit 240 may include a gyro sensor 241 or an acceleration sensor 243, and the gyro sensor 241 may sense information on the movement of the remote control device 200.

For example, the gyro sensor 241 may sense information on the operation of the remote control device 200 on the basis of x, y, and z axes, and the acceleration sensor 243 may sense information on a movement speed of the remote control device 200. Moreover, the remote control device 200 may further include a distance measurement sensor and sense a distance from the remote control device 200 to the display unit 180 of the display device 100.

The output unit 250 may output image or voice signals in response to operation of the user input unit 230 or image or voice signals corresponding to signals transmitted from the display device 100. A user can recognize whether the user input unit 230 is operated or the display device 100 is controlled through the output unit 250.

For example, the output unit 250 may include an LED module 251 for flashing, a vibration module 253 for generating a vibration, a sound output module 255 for outputting a sound, or a display module 257 for outputting an image, if the user input unit 230 is operated or signals are transmitted and received to and from the display device 100 through the wireless communication unit 220.

Additionally, the power supply unit 260 supplies power to the remote control device 200 and, if the remote control device 200 does not move during a predetermined period of time, stops supplying power, so that power waste can be reduced. The power supply unit 260 may resume the supply of power if a predetermined key provided in the remote control device 200 is operated.

The memory 270 may store various types of programs and application data necessary for the control or operation of the remote control device 200. If the remote control device 200 transmits and receives signals wirelessly through the display device 100 and the RF module 221, the remote control device 200 and the display device 100 transmit and receive signals through a predetermined frequency band.

The controller 280 of the remote control device 200 may store, in the memory 270, information on a frequency band for transmitting and receiving signals wirelessly to and from the display device 100 paired with the remote control device 200 and refer to the information.

The controller 280 controls the overall operation of the remote control device 200. The controller 280 may transmit a signal corresponding to a predetermined key operation of the user input unit 230 or a signal corresponding to a movement of the remote control device 200 sensed by the sensor unit 240 to the display device 100 through the wireless communication unit 220.

Additionally, the voice acquisition unit 290 of the remote control device 200 may obtain a voice.

The voice acquisition unit 290 may include at least one microphone 291 and acquire a voice through the microphone 291.

Figure 4:
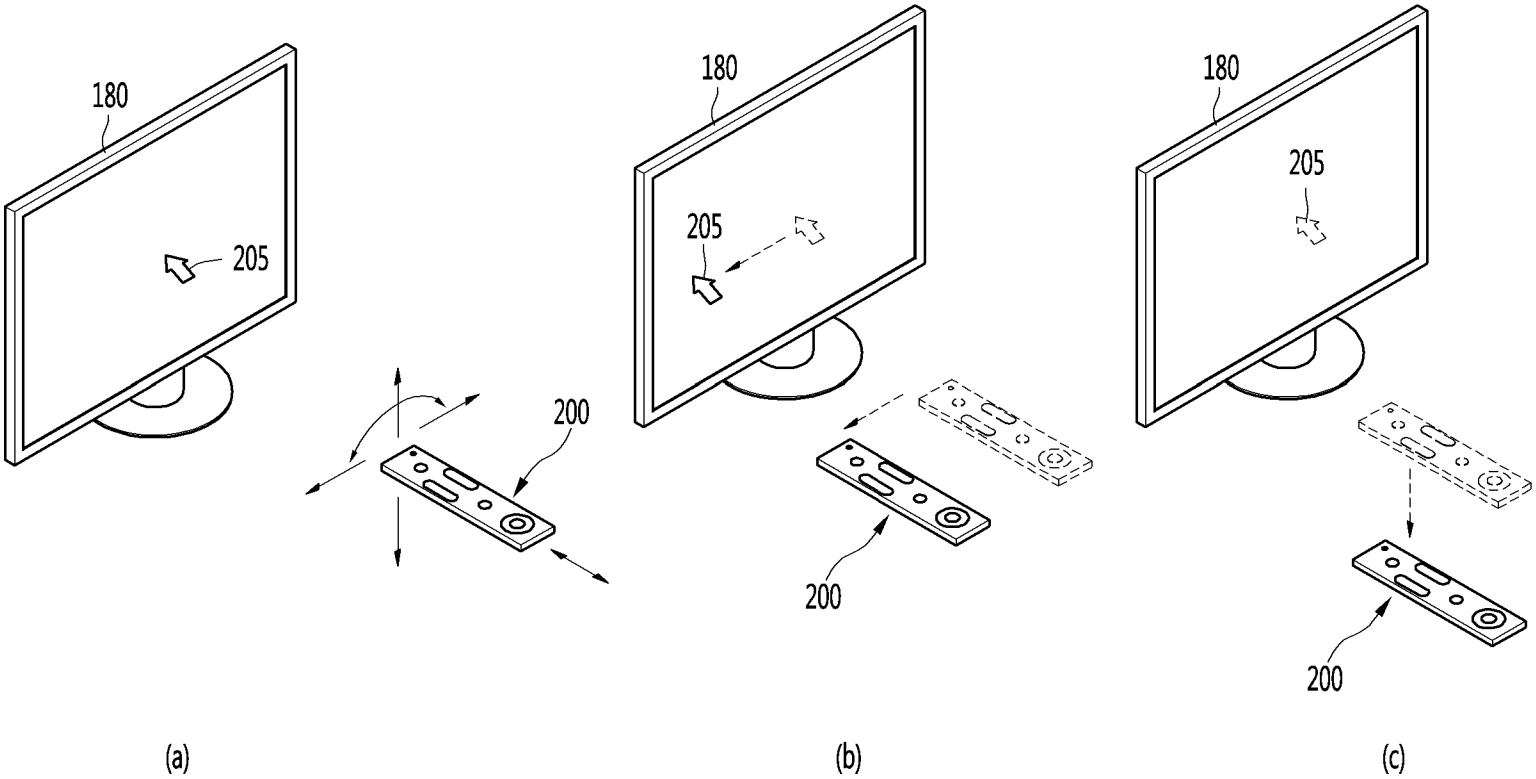
FIG. 4 is a view of utilizing a remote control device according to an embodiment of the present invention.

Next, FIG. 4 is described.

FIG. 4 illustrates an example of utilizing the remote control device according to an embodiment of the present invention.

FIG. 4A illustrates an example in which a pointer 205 corresponding to the remote control device 200 is displayed on the display unit 180.

A user can move or rotate the remote control device 200 vertically or horizontally. The pointer 205 displayed on the display unit 180 of the display device 100 corresponds to the movement of the remote control device 200. Since the pointer 205 is moved and displayed according to a movement on a 3D space as shown in the drawing, the remote control device 200 may also be referred to as a spatial remote control device.

FIG. 4B illustrates an example in which if a user moves the remote control device 200 to the left, the pointer 205 displayed on the display unit 180 of the display device 100 is also moved to the left according to the movement of the remote control device 200.

Information on the movement of the remote control device 200 detected through a sensor of the remote control device 200 is transmitted to the display device 100. The display device 100 may calculate the coordinates of the pointer 205 from the information on the movement of the remote control device 200. The display device 100 may display the pointer 205 at a position corresponding to the calculated coordinates.

FIG. 4C illustrates an example in which while a specific button in the remote control device 200 is pressed, a user moves the remote control device 200 away from the display unit 180. Due to this, a selection area in the display unit 180 corresponding to the pointer 205 may be zoomed in and displayed larger.

On the contrary, if a user moves the remote control device 200 in a direction closer to the display unit 180, a selection area in the display unit 180 corresponding to the pointer 205 may be zoomed out and displayed in a reduced size.

On the other hand, if the remote control device 200 is moved away from the display unit 180, a selection area may be zoomed out, and if the remote control device 200 is moved closer to the display unit 180, a selection area may be zoomed in.

Additionally, if a specific button in the remote control device 200 is pressed, recognition of a vertical or horizontal movement may be excluded. That is, if the remote control device 200 is moved away from or closer to the display unit 180, the up, down, left, or right movement may not be recognized and only the back and forth movement may be recognized. While a specific button in the remote control device 200 is not pressed, only the pointer 205 is moved according to the up, down, left, or right movement of the remote control device 200.

The moving speed or moving direction of the pointer 205 may correspond to the moving speed or moving direction of the remote control device 200.

On the other hand, the pointer 205 in this specification means an object displayed on the display unit 180 in response to the operation of the remote control device 200. Accordingly, besides an arrow form displayed as the pointer 205 in the drawing, various forms of objects are possible. For example, the above concept includes a point, a cursor, a prompt, and a thick outline. The pointer 205 may be displayed corresponding to one point of a horizontal axis and a vertical axis on the display unit 180 and can also be displayed corresponding to a plurality of points such as a line and a surface.

Next, a driving principle of an OLED will be described with reference to FIG. 5.

Figure 5:
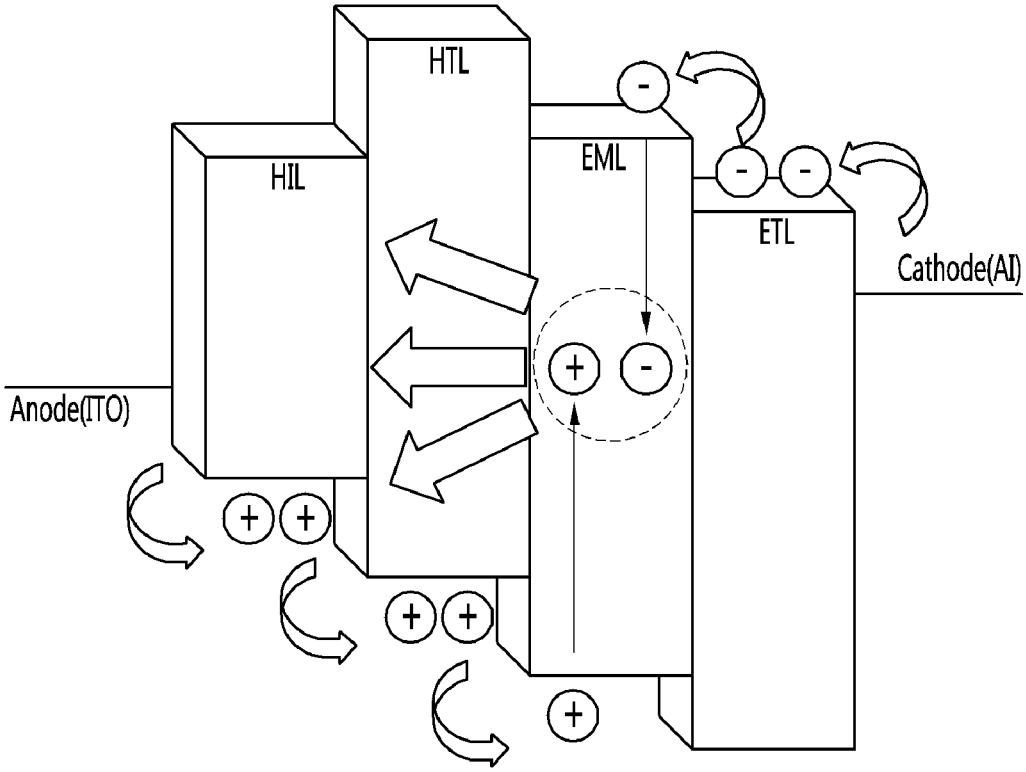
FIG. 5 is a view for describing a driving principle of an OLED included in an OLED display device according to the present invention.

FIG. 5 is a view for describing a driving principle of an OLED included in an OLED display device according to the present invention.

An OLED has a structure in which a transparent indium tin oxide (ITO) anode layer is formed on a transparent substrate such as glass, and a multi-layered thin film of organic materials having different transport capabilities and a cathode of an Mg—Ag alloy are sequentially formed on the anode layer.

The anode layer includes an anode and a cathode, and the anode layer includes a transparent electrode, such as ITO, so that light generated in an emitting layer is transmitted toward the outside. Since the OLED is a charge injection type light emitting device, charge injection efficiency between interfaces is a factor that has the greatest influence on the performance of the device.

The emitting layer (EML) is a layer in which holes (+) passing through the anode and electrons (−) passing through the cathode recombine to generate light.

Specifically, in the OLED, as a voltage is applied between two electrodes, holes and electrons are injected from the anode and the cathode, respectively, and when the holes and the electrons reach the emitting layer, the holes and the electrons recombine in the emitting layer to form excitons of an excited state. Light is obtained by emission recombination of the excitons and becomes a ground state. At this time, an emission wavelength is determined by energy of exciton, that is, an energy difference between HOMO (Highest Occupied Molecular Orbitals) and LUMO (Lowest Unoccupied Molecular Orbitals), and the generated light is emitted toward the transparent electrode (anode). The light generated in the emitting layer emits red, blue, and green colors, and a spectrum thereof is determined according to bond energy in the emitting layer. Therefore, an emission color is determined according to a material for forming the emitting layer.

Additionally, the OLED further includes a hole injection layer (HIL), a hole transfer layer (HTL), and an electron transfer layer (ETL), which enable the holes and the electrons to be easily moved to the emitting layer.

The hole transfer layer uses an electron donating molecule having small ionization potential so as to facilitate hole injection from the anode. Diamine, triamine, or tetramine derivatives having triphenylamine as a basic are mainly used.

The electron transfer layer is a layer that smoothly transfers electrons supplied from the cathode to the emitting layer and suppresses the movement of holes not bonded in the emitting layer, thereby increasing recombination probability in the emitting layer. The electron transfer layer is required to have excellent electron affinity and adhesion to the cathode electrode.

Next, the operation of a pixel circuit, to which the OLED is connected, will be described with reference to FIG. 6.

Figure 6:
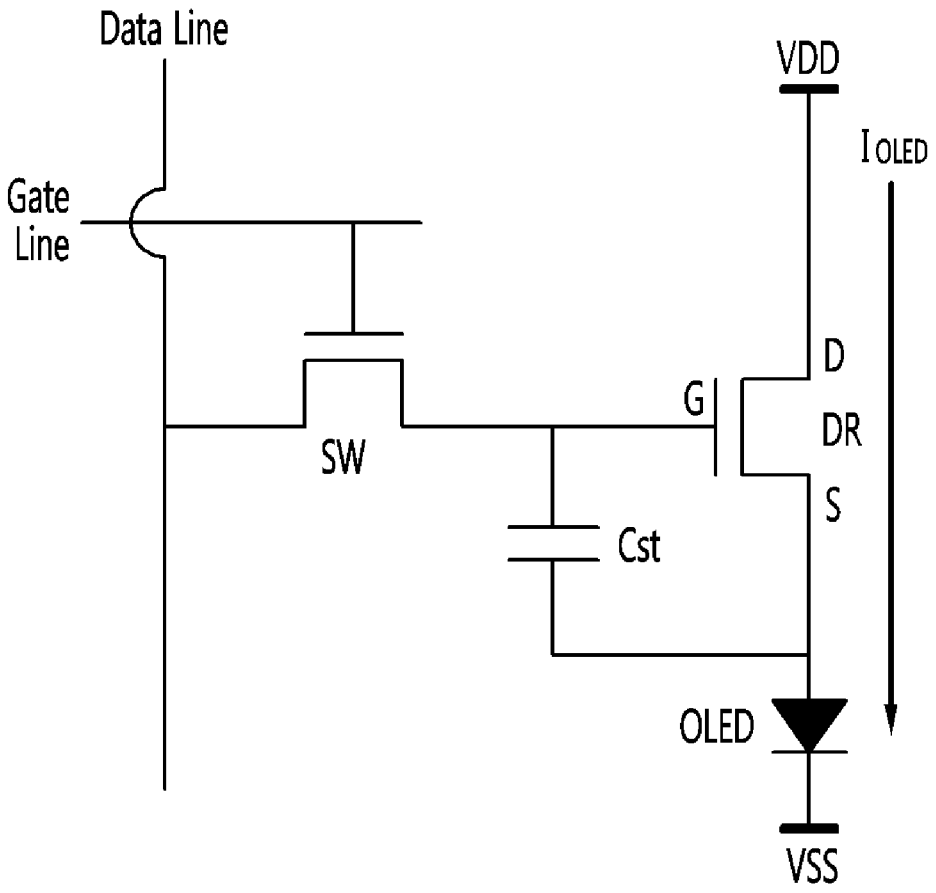
FIG. 6 is an equivalent circuit diagram of a pixel to which the OLED of FIG. 5 is connected, according to an embodiment of the present invention.

FIG. 6 is an equivalent circuit diagram of a pixel to which the OLED of FIG. 5 is connected, according to an embodiment.

The pixel of the OLED display device generally includes two transistors and one capacitor (2T1C). Specifically, referring to FIG. 6, the pixel of the OLED display device includes a data line and a gate line intersecting with each other, a switch TFT SW, a drive TFT DR, and a storage capacitor Cst.

The switch TFT SW is turned on in response to a scan pulse from the gate line so that a current path is formed between a source electrode and a drain electrode thereof. During on-time duration of the switch TFT SW, a data voltage from the data line is applied to a gate electrode of the drive TFT DR and one electrode of the storage capacitor Cst through the source electrode and the drain electrode of the switch TFT SW.

The storage capacitor Cst stores a difference voltage between the data voltage and a high-potential driving voltage VDD (drive voltage) and constantly maintains the difference voltage during one frame period, and the drive TFT DR controls a current $I_{OLED}$ flowing through the OLED according to the data voltage applied to the gate electrode thereof.

The source-drain voltage of the TFT is determined by the driving voltage VDD applied to the OLED. The driving voltage VDD shown in FIG. 6 may be substantially the same as a display driving voltage shown in FIGS. 7 to 17.

Meanwhile, the OLED does not emit light when a voltage level of a driving voltage VDD is lower than a predetermined level (for example, about 5 V), and may emit light when the voltage level of the driving voltage VDD is higher than the predetermined level. That is, the predetermined level may correspond to a minimum voltage level for light emission of the OLED.

At the time of driving the OLED display device 100 including the display unit 180 in which pixels are configured by such OLEDs, the power supply unit 190 may supply a voltage to the display unit 180. In this case, a display driving voltage EVDD or VDD may be applied to the display unit 180. For example, a voltage level of the display driving voltage EVDD applied for the operation of the display unit 180 may correspond to a driving level (for example, about 24 V).

When the power is turned off during the driving of the OLED display device 100, the controller 170 may perform control such that the driving of the display unit 180 is terminated. Additionally, as the power is turned off, the supply of power from the power supply unit 190 to the display unit 180 may be interrupted.

Even when the supply of power from the power supply unit 190 is interrupted, residual current is present between the power supply unit 190 and the display unit 180 during a predetermined period of time. Due to the residual current, the display driving voltage EVDD may be applied to the display unit 180 during a predetermined period of time. Since the supply of power from the power supply unit 190 is interrupted, the voltage level of the display driving voltage EVDD applied to the display unit 180 may be slowly lowered from the driving level by natural discharge.

For example, when the power is turned on again immediately after the user operates the remote control device 200 to turn off the power of the OLED display device 100, the power of the OLED display device 100 is turned on again before the voltage level of the display driving voltage EVDD becomes lower than the minimum voltage level for light emission of the OLED, and the controller 170 may drive the display unit 180.

In this case, when the display unit 180 is driven in a state in which the display driving voltage EVDD having a voltage level higher than the minimum voltage level is applied to the OLED, noise or afterimage caused by the light emission of the OLED may appear in the display unit 180.

In order to prevent the noise or afterimage from occurring when the power is turned on immediately after the power is turned off, the controller 170 may adjust the power-on time such that the power of the display device 100 is turned on after the OLED element is completely turned off as the voltage level of the display driving voltage EVDD becomes lower than the minimum voltage level even when a power-on command is inputted immediately after the power is turned off. However, in the case of delay discharge, the discharge speed is slow. Thus, the time when the power of the display device 100 is turned on again is delayed, causing inconvenience to the user.

In order to increase the discharge speed of the display driving voltage EVDD when the power is turned off, OLED display device according to one embodiment includes a discharge loop that is connected to a power supply line between a power supply unit and a display unit and is configured by a plurality of resistors.

However, in this embodiment, a current flows through the discharge loop even when the display device is driven, thus causing heat generation and unnecessary power consumption. Additionally, as the total resistance value of the discharge loop becomes lower, the discharge speed may increase. However, in this embodiment, since a current flows through the discharge loop even when the display device 100 is being driven, a sufficient amount of current may not flow through the display unit 180 when a resistance value of the discharge loop is low. Due to this problem, the discharge loop has not been configured to have a sufficient low resistance value, and the discharge speed has not increased (for example, the discharge time until the voltage level of the display driving voltage EVDD becomes lower than the minimum voltage level was about 3.5 seconds).

Since the discharge speed does not sufficiently increase, it may take some time until the power of the display device 100 is turned on, when the power-on command is inputted immediately after the power of the display device 100 is turned off. Accordingly, the user may feel inconvenience in using the display device 100, and may not be satisfied in terms of the performance of the display device 100.

The OLED display device 100 according to the embodiment of the present invention may solve the above-described problems by including a discharge unit (also referred to herein as a discharge circuit) configured to improve the discharge speed of the display driving voltage EVDD and a discharge control unit (also referred to herein as discharge control circuit or discharge controller) configured to control the discharge unit so as not to consume power during the driving of the OLED display device 100. This will be described below with reference to FIGS. 7 to 17.

Figure 7:
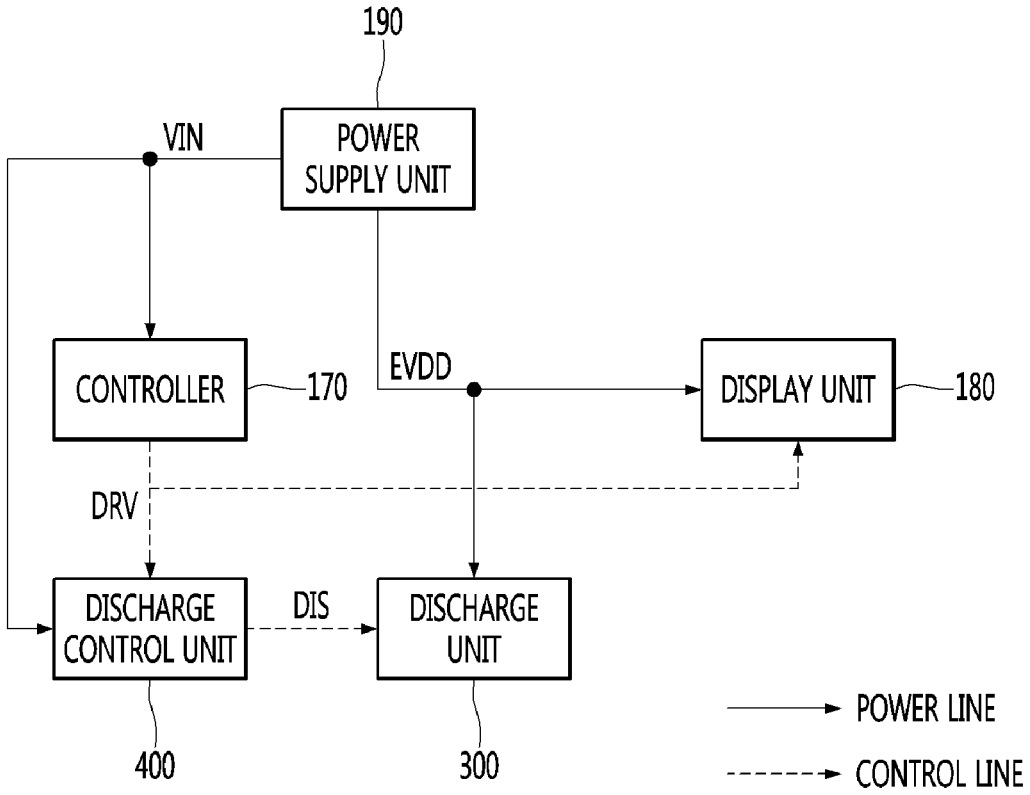
FIG. 7 is a schematic block diagram of an OLED display device including a discharge unit and a discharge control unit, according to an embodiment of the present invention.

FIG. 7 is a schematic block diagram of an OLED display device including a discharge unit and a discharge control unit, according to an embodiment of the present invention.

Referring to FIG. 7, an OLED display device 100 (hereinafter, referred to as a "display device 100") may further include a discharge unit 300 and a discharge control unit 400, as well as the elements shown in FIG. 1.

Among them, the display unit 180 may include pixels each configured by an OLED.

The discharge unit 300 may be connected to the display unit 180 of the display device 100 and perform a discharge operation with respect to the display driving voltage EVDD when the power of the display device 100 is turned off.

The discharge control unit 400 may control the enabling and disabling of the discharge unit 300 based on a power state (on/off) of the display device 100. The enabling of the discharge unit 300 means that the discharge operation with respect to the display driving voltage EVDD is performed, and the disabling of the discharge unit 300 means that the discharge operation with respect to the display driving voltage EVDD is not performed.

The operations of the discharge unit 300 and the discharge control unit 400 will be described in more detail.

First, the discharge control unit 400 may apply a discharge signal DIS to the discharge unit 300 based on a driving signal DRV (drive signal) applied from the controller 170. The driving signal DRV corresponds to a signal for controlling whether to drive the display unit 180, and the discharge signal DIS corresponds to a signal for controlling the enabling and disabling of the discharge unit 300.

The controller 170 may drive the display unit 180 by applying the driving signal DRV to the display unit 180 while the power of the display device 100 is in an on-state. Additionally, the controller 170 may not apply the driving signal DRV when the power of the display device 100 is turned off, and the display unit 180 may not be driven because the driving signal DRV is not applied.

When the power is turned off during the driving of the display device 100, the power may not be supplied from the power supply unit 190 to the controller 170, the discharge control unit 400, and the display unit 180.

Meanwhile, the controller 170 may also apply the driving signal DRV to the discharge control unit 400. When the driving signal DRV is not applied, the discharge control unit 400 may apply the discharge signal DIS to the discharge unit 300.

Since the discharge unit 300 is enabled in response to the discharge signal DIS applied from the discharge control unit 400, the discharge unit 300 may perform the discharge operation with respect to the driving voltage EVDD. Due to the discharge operation of the discharge unit 300, residual current present in a power supply line between the power supply unit 190 and the display unit 180 may be discharged to the outside through the discharge unit 300. As a result, the voltage level of the display driving voltage EVDD applied to the display unit 180 may be rapidly lowered.

On the contrary, when the power of the display device 100 is turned on, input voltage VIN may applied as the power is supplied from the power supply unit 190 to the controller 170. Additionally, as the power is supplied from the power supply unit 190 to the display unit 180, the voltage level of the display driving voltage EVDD may rise to a driving level (for example, about 24 V).

While the power of the display device 100 is turned on, the controller 170 may apply the driving signal DRV to the display unit 180 and the discharge control unit 400. The display unit 180 may be driven as the driving signal DRV is applied.

The discharge control unit 400 may not apply the discharge signal DIS to the discharge unit 300 in response to the applied driving signal DRV. When the discharge signal DIS is not applied, the discharge unit 300 may not perform the discharge operation with respect to the display driving voltage EVDD.

According to an embodiment, each of the driving signal DRV and the discharge signal DIS may have a first state (for example, high) and a second state (for example, low) according to a voltage level thereof. For example, the application of the driving signal DRV or the discharge signal DIS may mean that the state of the driving signal DRV or the discharge signal DIS is the first state, and no application of the driving signal DRV or the discharge signal DIS may mean that the state of the driving signal DRV or the discharge signal DIS is the second state.

Figure 8:
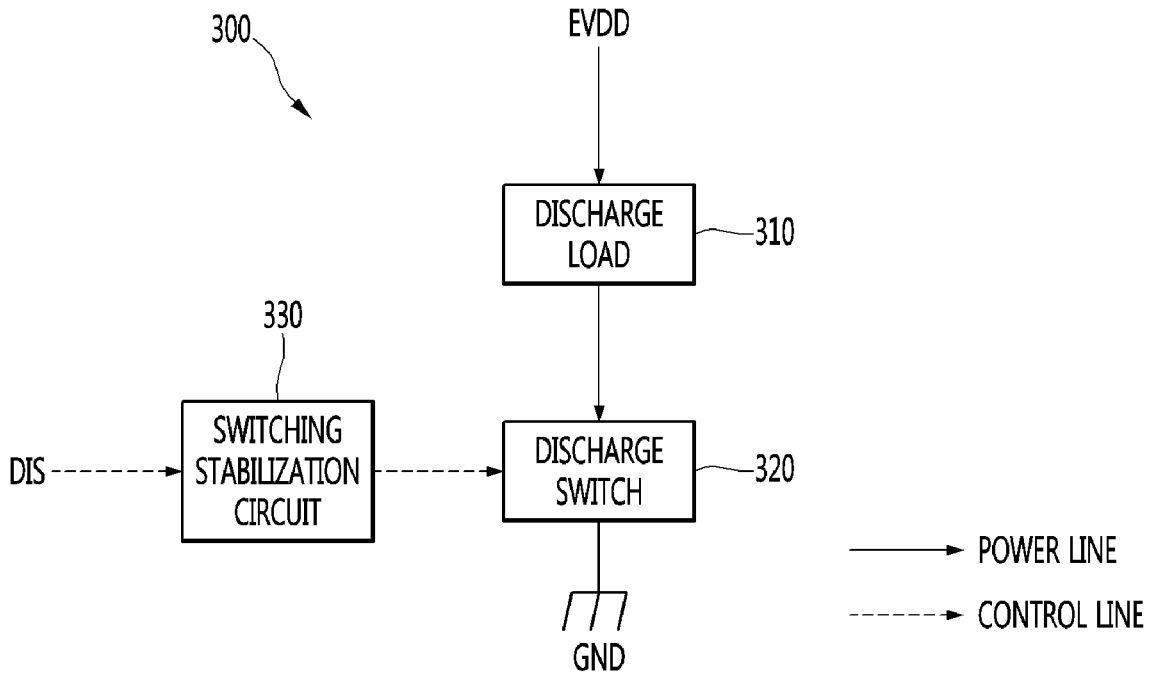
FIG. 8 is a block diagram illustrating a configuration of the discharge unit of FIG. 7.

FIG. 8 is a block diagram illustrating the configuration of the discharge unit of FIG. 7.

Referring to FIG. 8, the discharge unit 300 may include a discharge load 310 and a discharge switch 320.

The discharge load 310 may be connected to the display unit 180 to perform the discharge operation with respect to the display driving voltage EVDD according to the on/off of the discharge switch 320. For example, the discharge load 310 may include a plurality of resistors connected in parallel, but the present invention is not limited thereto.

The discharge switch 320 may be turned on and off based on the discharge signal DIS. When the discharge switch 320 is turned on, the discharge load 310 may be connected to a ground terminal GND, and residual current supplied to the display unit 180 may flow to the outside to the discharge load 310 and the ground terminal GND. Accordingly, the voltage level of the display driving voltage EVDD may be reduced. On the other hand, when the discharge switch 320 is turned off, the discharge load 310 is opened. Thus, no current may flow through the discharge load 310. That is, when the discharge switch 320 is turned on, the discharge unit 300 is enabled, and when the discharge switch 320 is turned off, the discharge unit 300 may be disabled.

According to an embodiment, the discharge unit 300 may further include a switching stabilization circuit 330. When the state in which the discharge signal DIS outputted from the discharge control unit 400 is applied is changed to the state in which the discharge signal DIS is not applied, or vice versa, the voltage level of the discharge signal DIS may be rapidly changed. When the voltage level of the discharge signal DIS is rapidly changed, various parts (the discharge switch 320 and the like) provided in the discharge unit 300 may be damaged. Therefore, the switching stabilization circuit 330 is configured to delay a changing speed of the voltage level of the discharge signal DIS at the time of changing the state of the discharge signal DIS, thereby preventing damage to parts due to the rapid change in the voltage level of the discharge signal DIS.

The configurations and the operations of the discharge load 310, the discharge switch 320, and the switching stabilization circuit 330 will be described in more detail with reference to FIG. 9.

Figure 9:
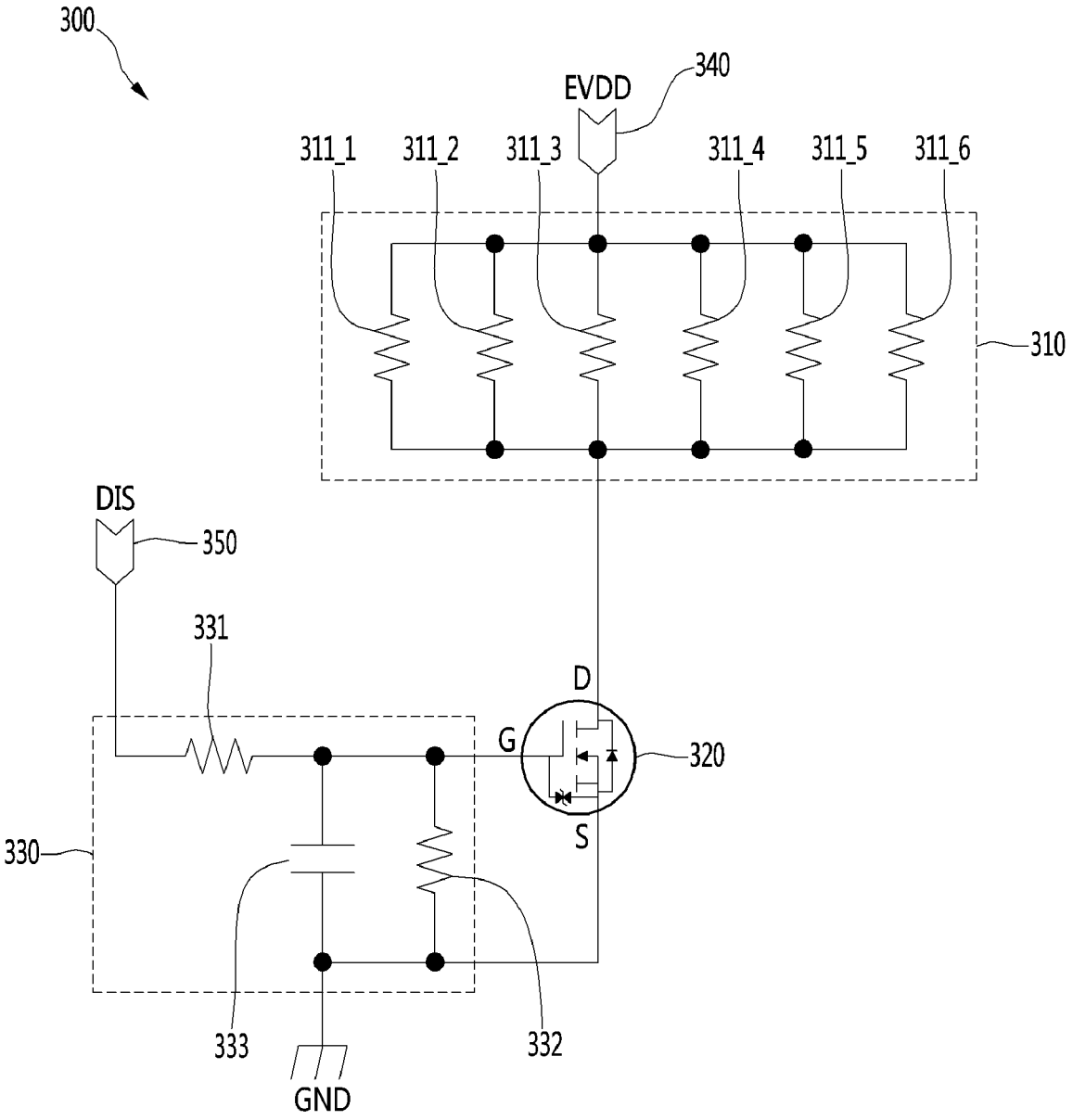
FIG. 9 is a circuit diagram of the discharge unit of FIG. 7 according to an embodiment of the present invention.

FIG. 9 is a circuit diagram of the discharge unit of FIG. 7 according to an embodiment of the present invention.

Referring to FIG. 9, the discharge unit 300 may be configured as a type of a discharge circuit including the discharge load 310 and the discharge switch 320.

The discharge load 310 may include a plurality of resistors 311_1 to 311_6 connected in parallel. The plurality of resistors 311_1 to 311_6 may have the same resistance value, but the present invention is not limited thereto.

The discharge switch 320 may be implemented by a field effect transistor (FET). When the discharge switch 320 is implemented by the FET, a gate terminal G of the FET may be connected to a discharge signal input terminal 350. Accordingly, the discharge signal DIS from the discharge control unit 400 may be applied to the gate terminal G. Additionally, one end of the discharge switch 320 (for example, a drain terminal D of the FET) may be connected to the discharge load 310, and the other end thereof (for example, a source terminal S of the FET) may be connected to the ground terminal GND.

When the discharge signal DIS is applied to the gate terminal G of the discharge switch 320 (when the power of the display device 100 is turned off), the discharge switch 320 may be turned on. When the discharge switch 320 is turned on, the discharge load 310 may be connected to the ground terminal GND through the discharge switch 320. As the discharge load 310 is connected to the ground terminal GND, the residual current supplied from the power supply unit 190 to the display unit 180 may be discharged to the outside through the display driving voltage terminal 340, the discharge load 310, the drain terminal D and the source terminal S of the discharge switch 320, and the ground terminal GND. As a result, the voltage level of the display driving voltage EVDD may be rapidly reduced.

On the other hand, when the discharge signal DIS is not applied (when the power of the display device 100 is turned on), the discharge switch 320 may be turned off. When the discharge switch 320 is turned off, the discharge load 310 is not connected to the ground terminal GND, and thus one end of the discharge load 310 may be opened. As one end of the discharge load 310 is opened, the current supplied from the power supply unit 190 may not flow through the discharge load 310 and may flow through the display unit 180. That is, the discharge load 310 may not consume power when the power of the display device 100 is turned on and thus the display device 100 is driven.

As the number of resistors 311_1 to 311_6 connected in parallel increases, the total resistance value of the discharge load 310 may be reduced. As the total resistance value of the discharge load 310 becomes smaller, the amount of current flowing through the discharge load 310 may increase. As a result, the discharge speed may increase. As the discharge speed increases, the discharge time of the display driving voltage EVDD may be shortened. The discharge time may mean the time taken until the display driving voltage EVDD is lowered from the first level (for example, about 24 V) at the time of driving the display device 100 to the second level (for example, about 5 V or less) at which the OLED element is turned off.

However, as the number of resistors included in the discharge load 310 increases, the volume and cost of the discharge load 310 may increase. Therefore, the number of resistors included in the discharge load 310 may be determined within the range in which the discharge time does not exceed a reference time. For example, according to the embodiment of the present invention, the discharge time may be about 1.5 seconds.

In general, as a screen size of the display unit 180 increases, the amount of current supplied from the power supply unit 190 to the display unit 180 may increase. In this case, if the total resistance value of the discharge load 310 is constant without regard to the screen size of the display unit 180, the discharge time may also increase when the screen size of the display unit 180 increases.

Therefore, according to the embodiment of the present invention, as the screen size of the display unit 180 increases, the total resistance value of the discharge load 310 is configured to be reduced, thereby minimizing a difference of the discharge time according to the screen size of the display unit 180. For example, when it is assumed that the discharge load is configured by the same resistors, the number of resistors included in the discharge load 310 may increase as the screen size of the display unit 180 increases.

As one example, it is assumed that when the screen size of the display unit 180 is a first size (for example, 55 inches), a first number of resistors are coupled to the discharge load 310 in parallel, and the total resistance value of the discharge load 310 is a first value. In this case, when the screen size of the display unit 180 is a second size (for example, 65 inches) larger than the first size, a second number (for example, four) of resistors larger than the first number are coupled to the discharge load 310 in parallel, and the total resistance value of the discharge load 310 is a second value smaller than the first value.

On the other hand, the switching stabilization circuit 330 is connected between the gate terminal G of the discharge switch 320 and the discharge control unit 400 (or the discharge signal input terminal 350), and thus the switching speed during the switching of the discharge signal DIS applied from the discharge control unit 400 may be delayed and the noise may be removed. To this end, the switching stabilization circuit 330 may include resistors 331 and 332 and a capacitor 333.

Figure 10:
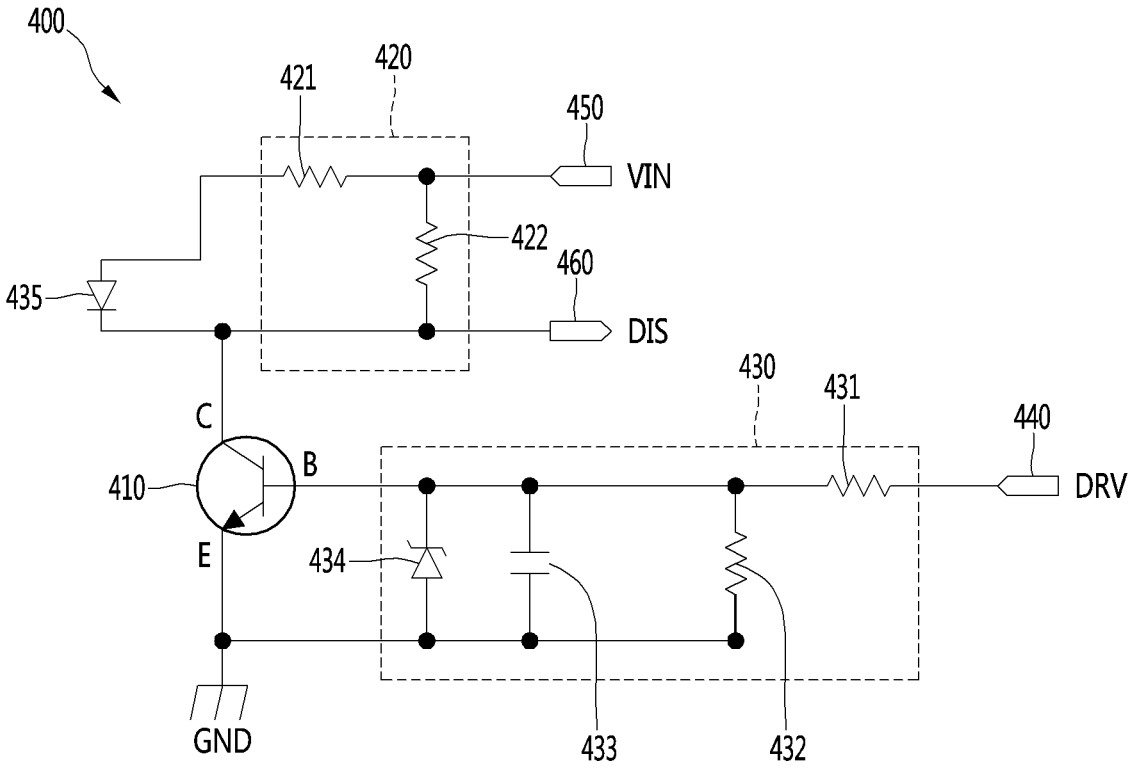
FIG. 10 is a circuit diagram of the discharge control unit of FIG. 7 according to an embodiment of the present invention.

FIG. 10 is a circuit diagram of the discharge control unit of FIG. 7 according to an embodiment of the present invention.

Referring to FIG. 10, the discharge control unit 400 may include a control switch 410 configured to apply a discharge signal DIS based on a driving signal DRV.

The control switch 410 may be implemented by a bipolar junction transistor as shown in FIG. 10, but the present invention is not limited thereto. A base terminal B of the control switch 410 may be connected to the controller 170 through a driving signal input terminal 440, and the controller 170 may apply the driving signal DRV to the base terminal B. Additionally, one end (for example, a collector terminal C) of the control switch 410 may be connected between an input voltage terminal 450 and a discharge signal output terminal 460, that is, between the power supply unit 190 and the discharge unit 300 (or the discharge switch 320), and the other end (for example, an emitter terminal E) of the control switch 410 may be connected to the ground terminal GND.

When the driving signal DRV is applied to the base terminal B of the control switch 410 (when the power of the display device 100 is turned off), the control switch 410 may be turned on. When the control switch 410 is turned on, the input voltage terminal 450 and the ground terminal GND may be connected together through the collector terminal C and the emitter terminal E of the control switch 410. That is, since the power supply unit 190 and the ground terminal GND are connected through the control switch 410, an input voltage VIN applied from the power supply unit 190 may be outputted to the ground terminal GND through the control switch 410 and may not be outputted to the discharge signal output terminal 460. Accordingly, the voltage is not applied to the discharge signal output terminal 460. As a result, the discharge signal DIS may not be applied to the discharge switch 320 of the discharge unit 300.

On the other hand, when the driving signal DRV is not applied (when the power of the display device 100 is turned off), the control switch 410 may be turned off. When the control switch 410 is turned off, the input voltage terminal 450 may be connected to the discharge signal output terminal 460. That is, the power supply unit 190 may not be connected to the discharge switch 320 of the discharge unit 300. Accordingly, the voltage based on the residual current between the power supply unit 190 and the discharge control unit 400 or the voltage supplied from the capacitor connected to the power supply unit 190 may be applied to the discharge signal output terminal 460 and the discharge switch 320 of the discharge unit 300 in the form of the discharge signal DIS.

Meanwhile, when the power of the display device 100 is turned off, the voltage is not supplied from the power supply unit 190. Thus, the voltage level of the discharge signal DIS may be gradually reduced, and the discharge signal DIS may not be applied after the passage of a predetermined time.

According to an embodiment, the discharge control unit 400 may further include a voltage drop unit 420 connected to an input voltage source to be described below and configured to drop the input voltage VIN applied from the input voltage source. Due to the voltage drop unit 420, the voltage level of the discharge signal DIS may be lower than the voltage level of the input voltage VIN.

According to an embodiment, the discharge control unit 400 may further include a switching stabilization circuit 430 configured to be switched between the base terminal B and the driving signal input terminal 440. The switching stabilization circuit 430 may delay a switching speed during the switching of the driving signal DRV and remove noise. To this end, the switching stabilization circuit 430 may include resistors 431 and 432, a capacitor 433, and a diode 434.

According to an embodiment, the discharge control unit 400 may further include a zener diode configured to protect the control switch 410 from overvoltage of the input voltage VIN applied by the power supplied from the power supply unit 190.

Hereinafter, a case when the power of the OLED display device is turned off or on will be described in more detail with reference to FIGS. 11 to 17.

Figure 11:
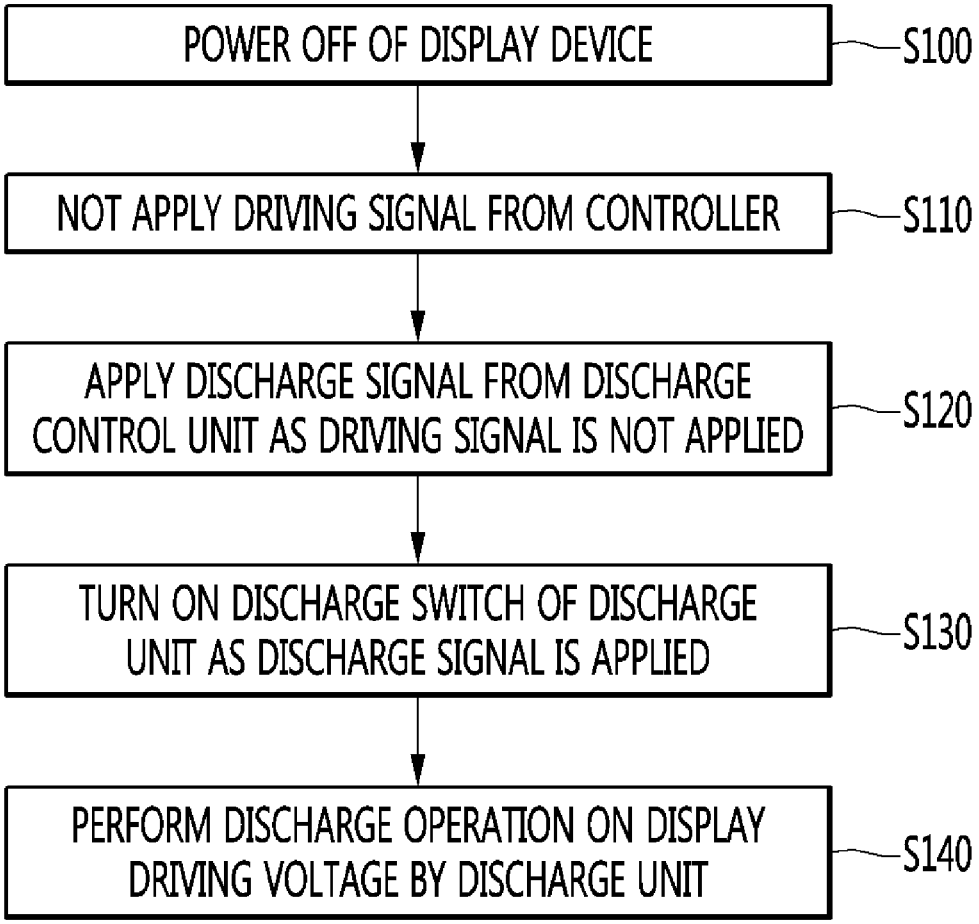
FIG. 11 is a flowchart of a method of discharging with respect to a display supply voltage, which is performed when the power of an OLED display device is turned off, according to an embodiment of the present invention.
Figure 12:
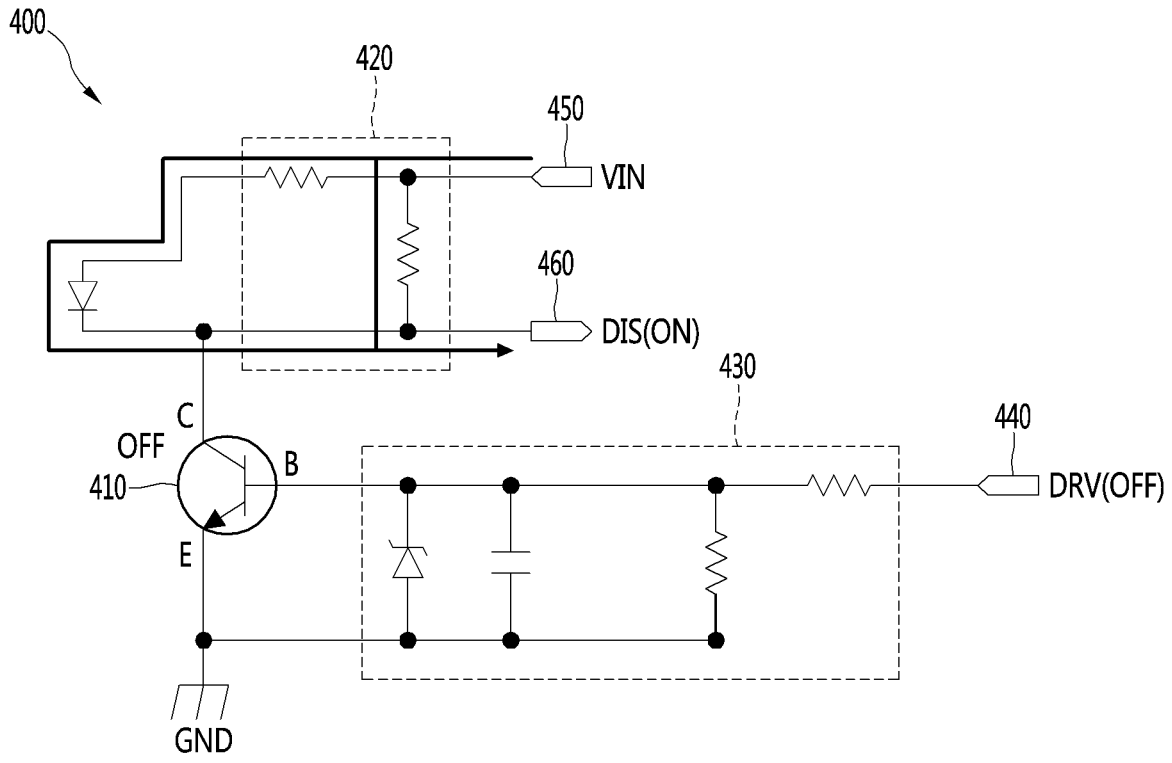
FIGS. 12 and 13 are views illustrating operations of a discharge control unit and a discharge unit, according to the embodiment illustrated in FIG. 11.
Figure 13:
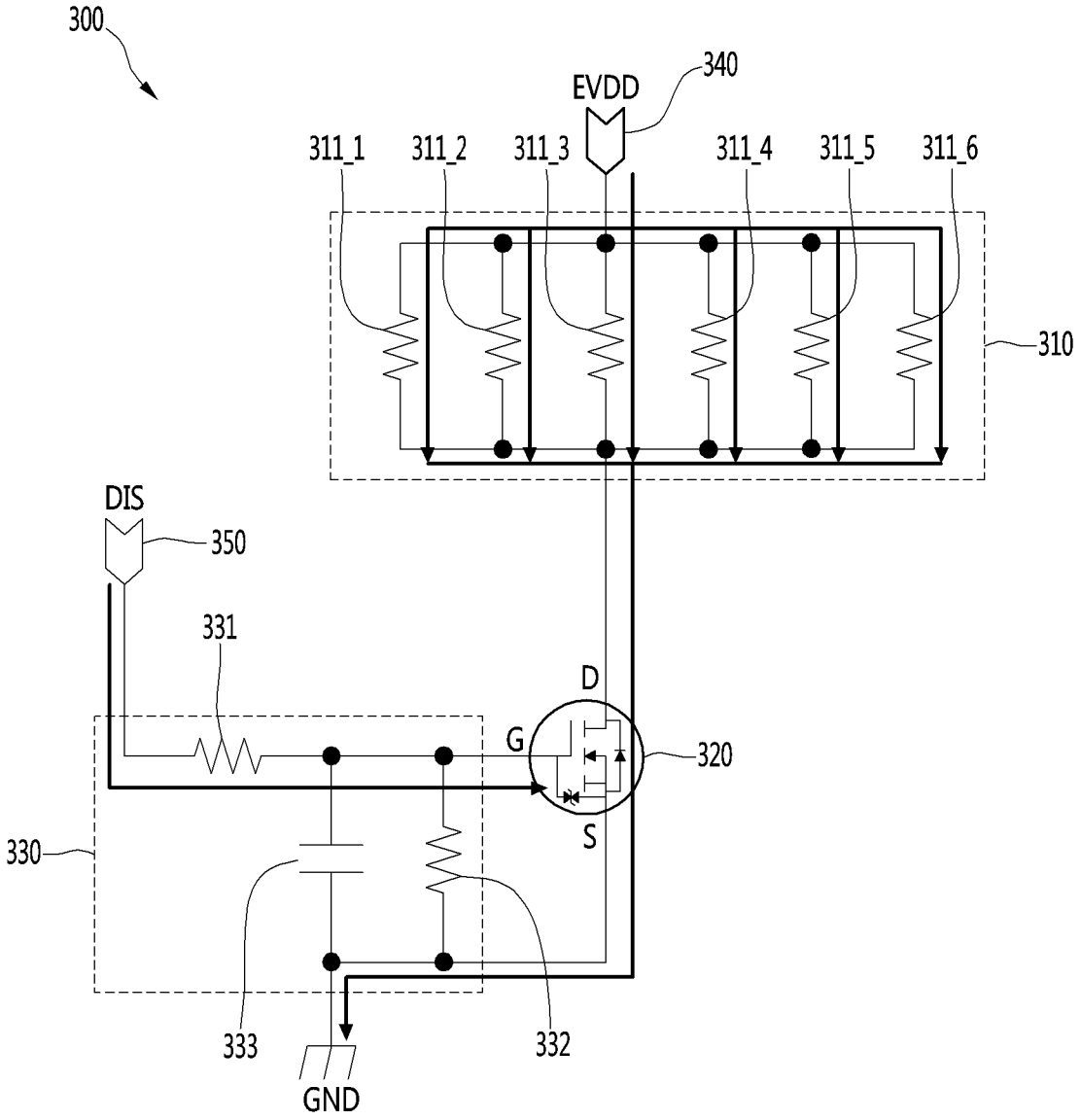

FIG. 11 is a flowchart of a method of discharging with respect to the display supply voltage, which is performed when the power of the OLED display device is turned off, according to an embodiment of the present invention, and FIGS. 12 and 13 are views illustrating the operations of the discharge control unit and the discharge unit according to the embodiment shown in FIG. 11.

Referring to FIG. 11, the power of the display device 100 may be turned off (S100). For example, the power of the display device 100 may be turned off when the user operates the power button 231 of the remote control device 200 to input the power-off command, when a power plug (not shown) of the display device 100 is separated from an outlet of a home or the like, or when the supply of power is interrupted from an external power system.

When the power of the display device 100 is turned off, the controller 170 may not apply the driving signal DRV (S110).

When the power of the display device 100 is turned off, the power may not be supplied from the power supply unit 190. Even when the power of supply is interrupted, the controller 170 may operate based on the input voltage VIN applied during a predetermined period of time by the input voltage source. For example, the input voltage source may be the power supply unit 190 or may correspond to the capacitor connected to the power supply unit 190. In a case where the input voltage source is the power supply unit 190, the applied input voltage VIN may be formed by the residual current supplied by the power supply unit 190 when the power of the display device 100 is turned off. When the input voltage source is the capacitor, the capacitor may charge the voltage VIN during the power supply of the power supply unit 190. When the power of the power supply unit 190 is interrupted, the capacitor may apply the input voltage VIN during a predetermined period of time based on the charged voltage.

At this time, the controller 170 may not apply the driving signal DRV to the display unit 180 and the discharge control unit 400 so as to turning off the driving of the display unit 180.

As the driving signal DRV is not applied, the discharge control unit 400 may apply the discharge signal DIS to the discharge unit 300 (S120).

When the driving signal DRV is not applied, the discharge control unit 400 may apply the discharge signal DIS so as to enable the discharge operation of the discharge unit 300.

In this regard, referring to FIG. 12, when the driving signal DRV is not applied, the control switch 410 may be turned off. When the control switch 410 is turned off, the voltage applied from the input voltage source (the power supply unit 190 or the capacitor connected to the power supply unit 190) may be applied to the discharge unit 300 through the discharge signal output terminal 460 in the form of the discharge signal DIS.

Referring to FIG. 11 again, as the discharge signal DIS is applied, the discharge switch 320 of the discharge unit 300 may be turned on (S130), and the discharge unit 300 may perform the discharge operation on the display driving voltage EVDD (S140).

In this regard, referring to FIG. 13, when the discharge signal DIS is applied, the discharge switch 320 may be turned on. As shown in FIG. 13, in a case where the discharge switch 320 is implemented by a FET switch, the discharge switch 320 is turned on when the voltage level of the discharge signal DIS received through the gate terminal G is higher than a predetermined level. Thus, the drain terminal D and the source terminal S may be connected to each other.

When the discharge switch 320 is turned on, the discharge load 310 may be connected to the ground terminal GND. Additionally, the display driving voltage terminal 340 may be connected to the ground terminal GND through the discharge load 310 and the discharge switch 320. In this case, due to the voltage difference between the display driving voltage terminal 340 and the ground terminal GND, the residual current supplied from the power supply unit 190 to the display unit 180 may be discharged to the outside through the discharge load 310, the discharge switch 320, and the ground terminal GND. As the residual current is discharged, the display driving voltage EVDD applied to the display unit 180 may be discharged.

Figure 14:
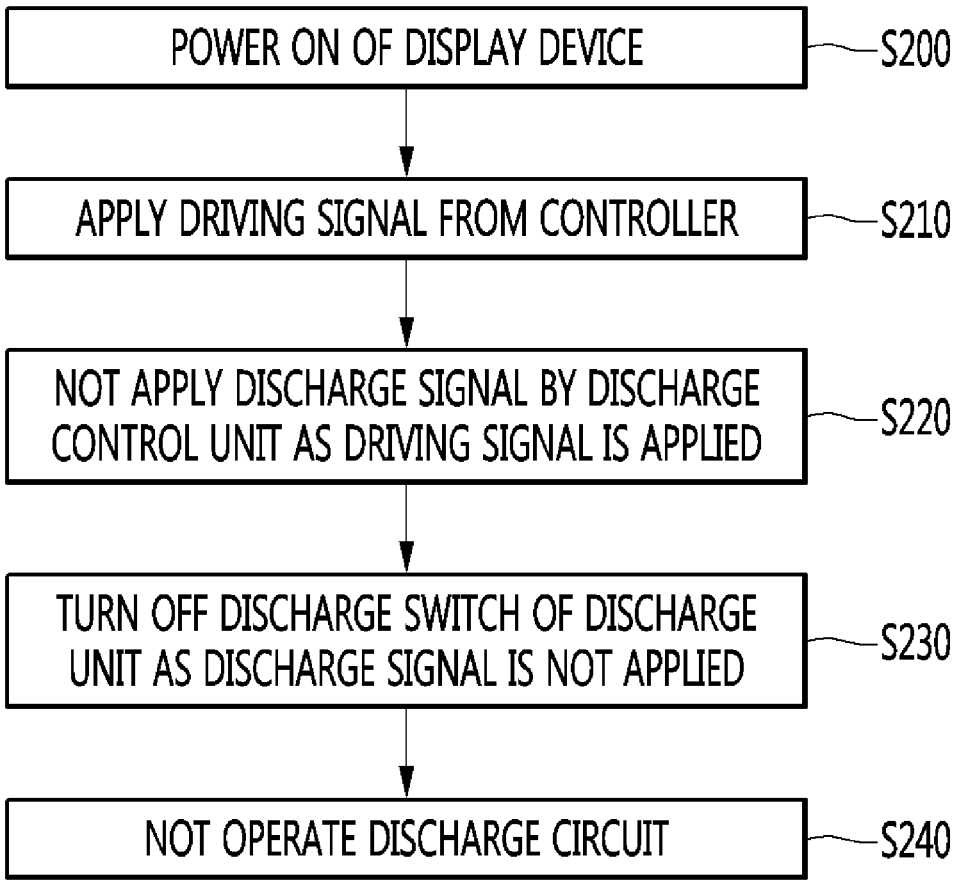
Figure 15:
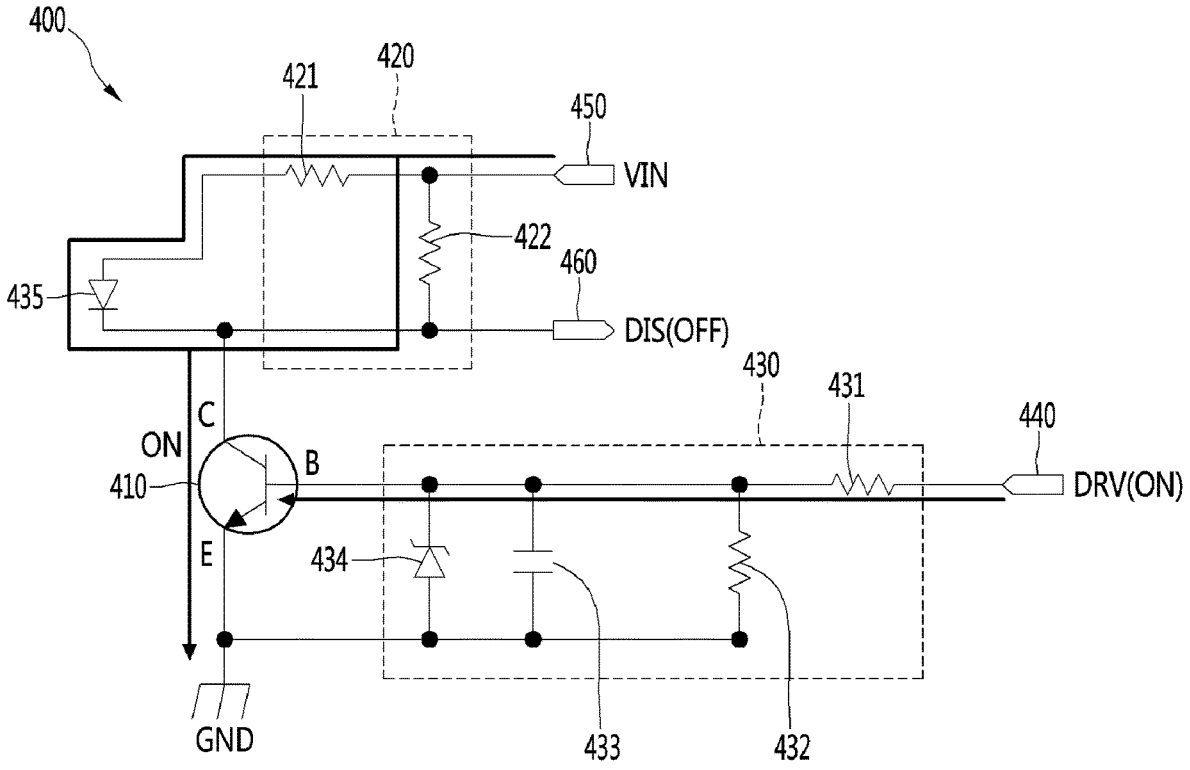
FIGS. 15 and 16 are views illustrating operations of a discharge control unit and a discharge unit, according to the embodiment illustrated in FIG. 14.
Figure 16:
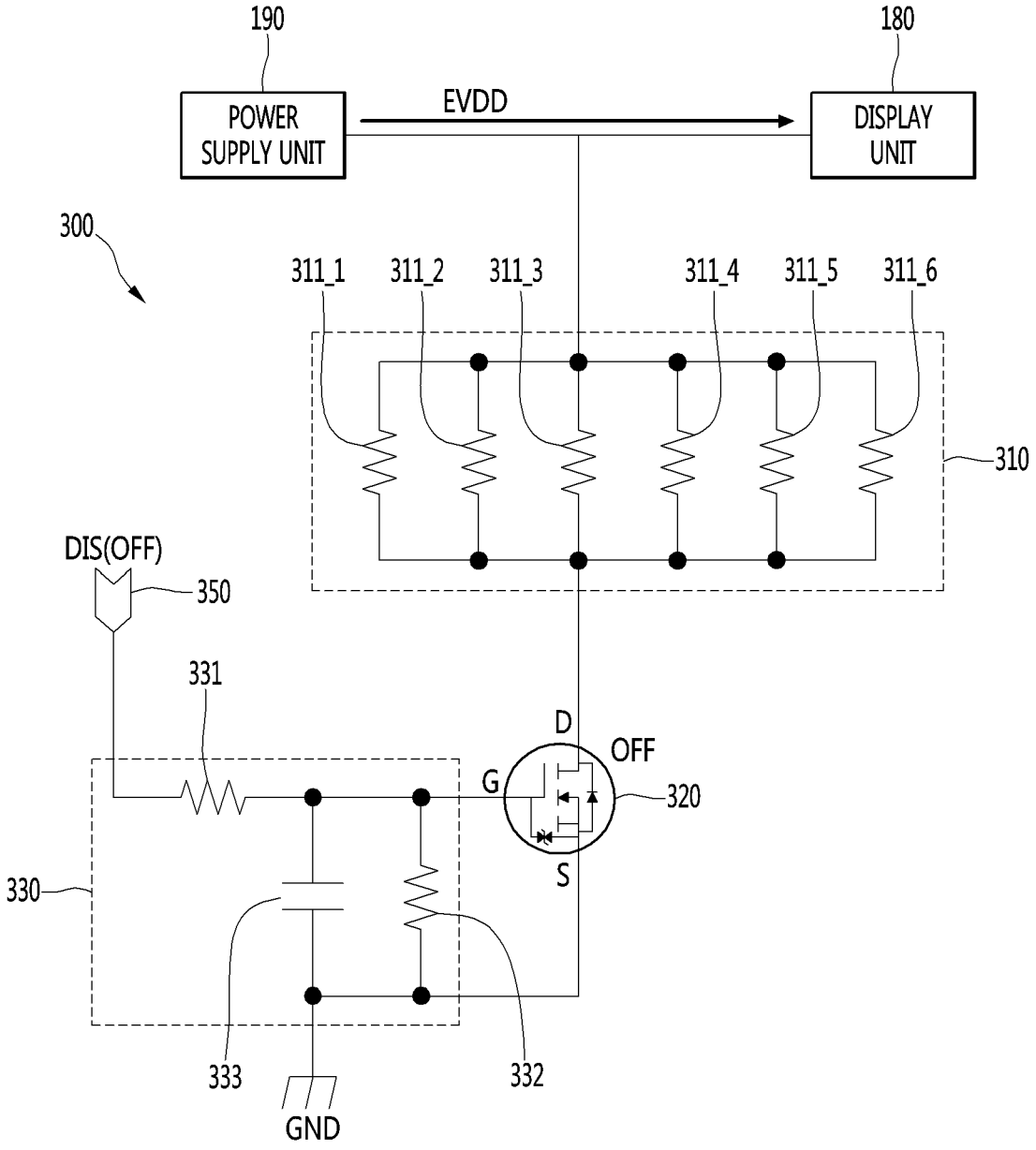

FIG. 14 is a flowchart for describing an operation when the power of the OLED display device is turned on, and FIGS. 15 and 16 are views illustrating the operations of the discharge control unit and the discharge unit according to the embodiment shown in FIG. 14.

Referring to FIG. 14, when the power of the display device 100 is turned on (S200), the controller 170 may apply the driving signal DRV (S210).

For example, when the user operates the power button 231 of the remote control device 200 to input the power-on command, the power of the display device 100 may be turned on.

When the power of the display device 100 is turned on, the power supply unit 190 may supply the voltage to the controller 170 and the discharge control unit 400. The controller 170 may operate based on the supplied power and apply the driving signal DRV to drive the display unit 180.

As the driving signal DRV is applied, the discharge control unit 400 may not apply the discharge signal DIS (S220).

In this regard, referring to FIG. 15, when the driving signal DRV is applied, the control switch 410 may be turned on. When the control switch 410 is turned on, the input voltage terminal 450, that is, the power supply unit 190, and the ground terminal GND may be connected together through the control switch 410. Accordingly, the voltage based on the input voltage VIN applied from the power supply unit 190 may not be applied to the discharge signal output terminal 460 and the discharge switch 320. That is, the discharge signal DIS may not be applied to the discharge switch 320 of the discharge unit 300.

According to an embodiment, when the power-on time point of the display device 100 is later than the power-off time point by a predetermined time, it may be a state in which the discharge signal DIS has not been applied at the power-on time point. In this case, the discharge control unit 400 may control such that the discharge signal DIS is not applied.

Referring to FIG. 14 again, as the discharge signal DIS is not applied, the discharge switch 320 of the discharge unit 300 may be turned off (S230), and the discharge unit 300 may not perform the discharge operation (S240).

In this regard, referring to FIG. 16, when the discharge signal DIS is not applied from the discharge control unit 400, the discharge switch 320 of the discharge unit 300 may be turned off. As the discharge switch 320 is turned off, the drain terminal D and the source terminal S may be disconnected from each other.

When the discharge switch 320 is turned off, one of both ends of the discharge load 310 is opened. Thus, no current may flow through the discharge load 310. Accordingly, the discharge load 310 may not perform the discharge operation on the display driving signal EVDD applied to the display unit 180.

Figure 17:
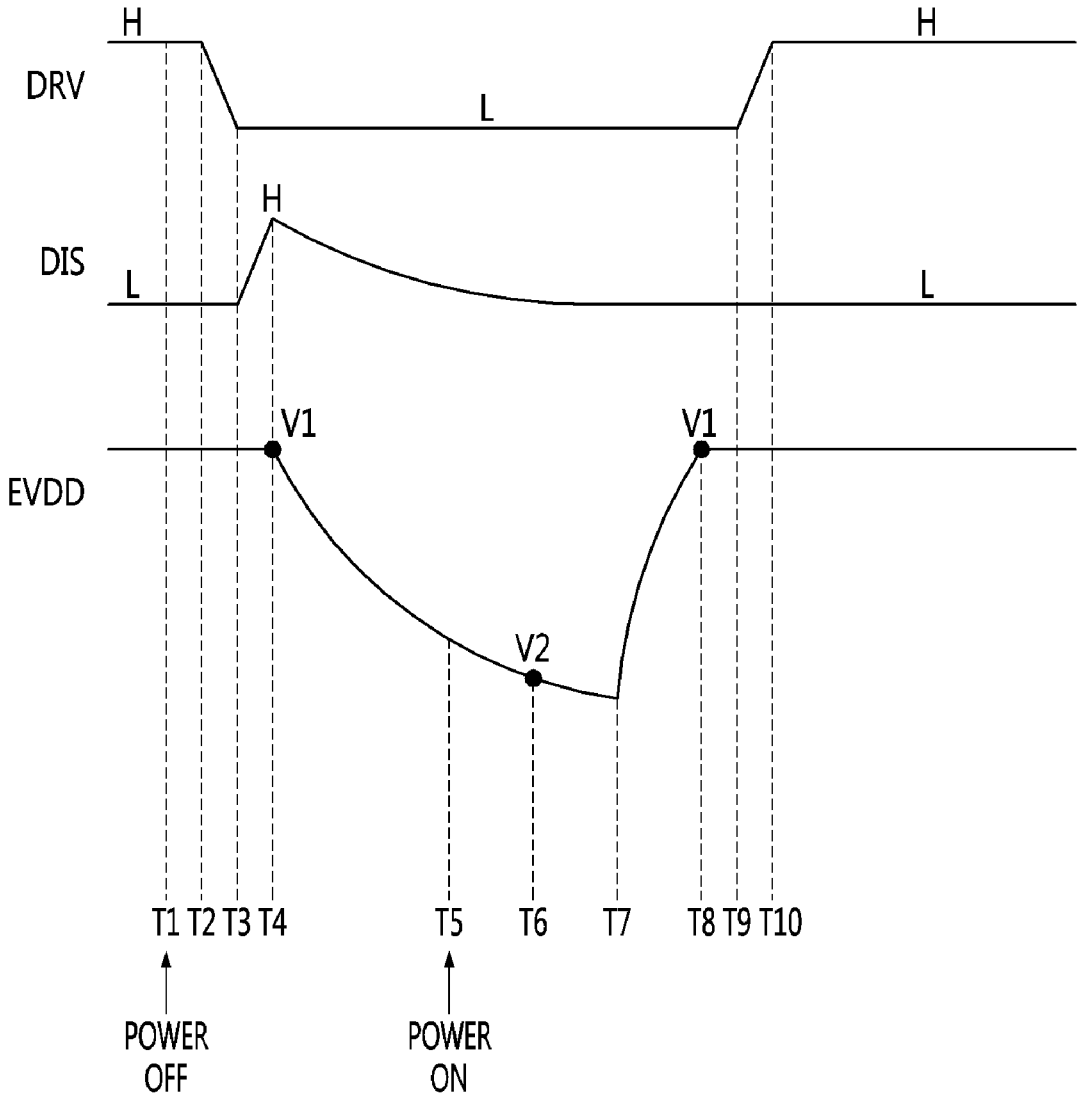
FIG. 17 is a timing diagram illustrating related signals and a change in a state of a display driving voltage when the power of the OLED display device is turned off and on, according to an embodiment of the present invention.

FIG. 17 is a timing diagram illustrating the related signals and the change in the state of the display driving voltage when the power of the OLED display device is turned off and on, according to an embodiment of the present invention.

In FIG. 17, it is assumed that, when the voltage level of the driving signal DRV or the discharge signal DIS is a first level (H), the driving signal DRV or the discharge signal DIS is applied, and when the voltage level of the driving signal DRV or the discharge signal DIS is a second level (L), the driving signal DRV or the discharge signal DIS is not applied.

When the power of the display device 100 is turned on and thus the display unit 180 is driven, the driving signal DRV may be applied from the controller 170. When the driving signal DRV is applied, the discharge control unit 400 may not apply the discharge signal DIS to the discharge unit 300 as described above. When the discharge signal DIS is not applied, the discharge unit 300 does not operate. Thus, no power may be consumed by using the power supplied from the power supply unit 190 to the display unit 180.

When the power of the display device 100 is turned off at a first time point T1, for example, when the user operates the power button 231 of the remote control device 200 to input the power-on command, the controller 170 may perform an operation of terminating the driving of each component so that the driving of the display device 100 is normally terminated.

During the operation of terminating the driving of each component, the controller 170 may switch the state of the driving signal DRV from an applied state to a non-applied state so as to terminate the driving of the display unit 180 at a second time point T2.

When the controller 170 does not apply the driving signal DRV, the voltage level of the driving signal DRV received through the control switch 410 of the discharge control unit 400 may be gradually reduced from the second time point T2 to a third time point T3 by the switching stabilization circuit 430 of the discharge control unit 400.

Since the driving signal DRV is not applied at the third time point T3, the control switch 410 of the discharge control unit 400 may be turned off. When the control switch 410 is turned off, the voltage may be applied to the discharge signal output terminal 460 based on the voltage applied from the input voltage source. Accordingly, the voltage level of the discharge signal DIS increases from the third time point T3 to a fourth time point T4. As a result, the discharge signal DIS may be applied to the discharge switch 320.

When the discharge signal DIS is applied to the discharge switch 320 at the fourth time point T4, the discharge switch 320 is turned on, so that the discharge load 310 is connected to the ground terminal GND. As the discharge load 310 is connected to the ground terminal GND, the discharge load 310 may perform the discharge operation on the display driving voltage EVDD.

The residual current between the power supply unit 190 and the display unit 180 is discharge through the discharge load 310 and the ground terminal GND, and thus the display driving voltage EVDD may be discharged. Due to the discharge operation of the discharge unit 300, the voltage level of the display driving voltage EVDD may be gradually reduced from the first level V1 corresponding to the driving level. For example, the first level V1 may be about 24 V.

When the voltage level of the display driving voltage EVDD is lower than a second level V2, the OLED element of the display unit 180 may be turned off. For example, the second level V2 may be about 5V.

Meanwhile, since an additional voltage is not supplied from the input voltage source after the passage of a predetermined time, the voltage level of the discharge signal DIS may be gradually reduced with the passage of time. Accordingly, the discharge signal DIS may not be applied after the passage of a predetermined time. Since the discharge signal DIS is not applied, the discharge operation of the discharge unit 300 may be terminated.

Accordingly, a sixth time point T6 when the voltage level of the display driving voltage EVDD is lower than the second level V2 may be earlier than a time point when the discharge signal DIS is not applied, but the present invention is not limited thereto.

According to an embodiment, the user may input the power-on command of the display device 100 by using the remote control device 200 at a fifth time point T5 when the voltage level of the display driving voltage EVDD becomes lower than the second level V2. For example, when the user turns off the power of the display device 100 by mistake, the user may intend to immediately turn on the power of the display device 100.

In this case, the controller 170 controls the components so that the power is turned on after the voltage level of the display driving voltage EVDD becomes lower than the second level V2, thereby preventing noise or afterimage from occurring when the display device 100 is turned on.

That is, the controller 170 may control the power supply unit 190 to supply power to the display unit 180 at a seventh time point T7 after the sixth time point T6. At an eighth time point T8, the voltage level of the display driving voltage EVDD may be increased to the first level V1 by the power supply of the power supply unit 190.

After the voltage level of the display driving voltage EVDD is increased to the first level V1, the controller 170 may drive the display unit 180 by applying the driving signal DRV at a ninth time point T9.

When the driving signal DRV is applied at a tenth time point T10, the control switch 410 of the discharge control unit 400 may be turned on. As a result, the voltage applied through the input voltage terminal 450 of the discharge control unit 400 may be outputted through the control switch 410 and the ground terminal GND, and may not be applied to the discharge signal output terminal 460. Accordingly, the discharge signal DIS may maintain a non-applied state and the discharge unit 300 may be disabled. Thus, the power consumption caused by the discharge load 310 may not occur.

That is, according to embodiments of the present invention, the discharge unit 300 may perform the discharge operation on the display driving voltage when the display device 100 is turned off, and may not operate when the display device 100 is turned on. Therefore, it is possible to prevent unnecessary power consumption caused by the discharge unit 300 during the operation of the display device 100 and prevent problems such as heat generation caused by the unnecessary power consumption.

Additionally, the total resistance value of the discharge load 310 included in the discharge unit 300 may be configured to be reduced as compared with the related art, thereby improving the discharge speed during the discharge of the display driving voltage EVDD. Therefore, when the power is turned on again immediately after the power of the display device 100 is turned off, the time of turning on the display device 100 may be greatly shortened as compared with the related art, thereby increasing user satisfaction in terms of the performance of the display device.

According to an embodiment, the above-described method may also be embodied as processor-readable codes on a program-recorded medium. Examples of the processor-readable medium may include a ROM, a RAM, a CD-ROM, a magnetic tape, a floppy disk, and an optical data storage device.

Embodiments provide an organic light emitting diode display device that improves a discharge speed of a display driving voltage applied to a display unit when power is turned off, thereby shortening a power-on time when a power-on command is inputted immediately after the power is turned off.

Embodiments also provide an organic light emitting diode display device capable of preventing unnecessary power consumption caused by a discharge unit while the power is turned on and the device is driven.

In one embodiment, an organic light emitting diode display device includes: a display unit including pixels each configured by an organic light emitting diode; a power supply unit configured to supply power for driving the display unit; a discharge unit connected to the display unit and configured to perform a discharge operation on a display driving voltage applied to the display unit; and a discharge control unit configured to control enabling and disabling of the discharge unit based on a power state of the organic light emitting diode display device.

The discharge unit may be disabled while the power of the organic light emitting diode display device is turned on, and the discharge control unit may enable the discharge unit when the power of the organic light emitting diode display device is turned off.

The discharge unit may include: a discharge load connected to the display unit; and a first switch connected between the discharge load and a ground terminal.

The discharge control unit may include a second switch having one end connected between the power supply unit and the first switch, and another end connected to the ground terminal.

When the second switch is turned off, the discharge control unit may apply a discharge signal to the first switch based on an input voltage applied from an input voltage source, the first switch may be turned on in response to the applied discharge signal, and the display driving voltage may be discharged by the discharge load.

The input voltage source may be the power supply unit.

The input voltage source may be a capacitor connected to the power supply unit. As the power of the organic light emitting diode display unit is turned off, the second switch may be turned off, and the discharge control unit may apply the discharge signal to the first switch based on a voltage charged to the capacitor.

The organic light emitting diode display device may further include a controller configured to apply a driving signal for driving the display unit, wherein the second switch may be turned on when the driving signal is applied, and may be turned off when the driving signal is not applied.

The discharge unit may further include a switching stabilization circuit provided between the discharge control unit and the first switch.

The discharge control unit may further include a voltage drop unit connected to the input voltage source and configured to drop the input voltage.

The discharge load may include a plurality of resistors connected in parallel.

When a screen size of the display unit is a first size, a total resistance value of the discharge load may be a first resistance value, and when the screen size of the display unit is a second size larger than the first size, the total resistance value of the discharge load may be a second resistance value smaller than the first resistance value.

When a screen size of the display unit is a first size, the discharge load may include a first number of resistors, and when the screen size of the display unit is a second size larger than the first size, the discharge load may include a second number of resistors, the second number being larger than the first number.

The first switch may be implemented by a field effect transistor (FET).

In another embodiment, a method of operating an organic light emitting diode display apparatus includes: turning off power of the organic light emitting diode display device; enabling, by a discharge control unit included in the organic light emitting diode display device, a discharge unit connected to a display unit of the organic light emitting diode display device; and performing, by the discharge unit, a discharge operation on a display driving voltage applied to the display unit.

The details of one or more embodiments are set forth in the accompanying drawings and the description below. Other features will be apparent from the description and drawings, and from the claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode display device, comprising:

a display including a plurality of pixels each including an organic light emitting diode;

a power supply configured to supply a display drive voltage to the display;

a discharge circuit connected to the display and configured to perform a discharge operation on the display drive voltage applied to the display; and a discharge control circuit configured to control the discharge circuit to be enabled or disabled based on a power state of the organic light emitting diode display device, wherein the discharge circuit further comprises a discharge load connected to the display and a first switch connected between the discharge load and a ground terminal, and wherein the first switch is turned off when the power of the organic light emitting diode display device is turned on, and the first switch is turned on when the power of the organic light emitting diode display device is turned off.

2. The organic light emitting diode display device according to claim 1, wherein the discharge circuit is disabled when the power of the organic light emitting diode display device is turned on, and the discharge control circuit enables the discharge circuit when the power of the organic light emitting diode display device is turned off.

3. The organic light emitting diode display device according to claim 1, wherein the first switch is turned on when a discharge signal is applied from the discharge control circuit.

4. The organic light emitting diode display device according to claim 1, wherein the discharge control circuit includes a second switch having one end connected between the power supply and the first switch, and another end connected to the ground terminal.

5. The organic light emitting diode display device according to claim 4, wherein, when the second switch is turned off, the discharge control circuit is configured to apply a discharge signal to the first switch, based on an input voltage source, and the first switch is turned on in response to the applied discharge signal, the first switch being configured to discharge the display drive voltage through the discharge load.

6. The organic light emitting diode display device according to claim 5, wherein the input voltage source is output by the power supply.

7. The organic light emitting diode display device according to claim 5, wherein the input voltage source is output by a capacitor connected to the power supply.

8. The organic light emitting diode display device according to claim 7, wherein, when the power of the organic light emitting diode display device is turned off, the second switch is turned off and the discharge control circuit is configured to apply the discharge signal to the first switch.

9. The organic light emitting diode display device according to claim 5, further comprising a controller configured to apply a drive signal that drives the display, wherein the second switch in the discharge control circuit is turned on to turn off the discharge signal when the drive signal is applied, and the second switch is turned off to turn on the discharge signal when the drive signal is not applied.

10. The organic light emitting diode display device according to claim 5, wherein the discharge circuit includes a switching stabilization circuit provided between the discharge control circuit and the first switch.

11. The organic light emitting diode display device according to claim 5, wherein the discharge control circuit includes a voltage drop circuit connected to the input voltage source and configured to drop the input voltage.

12. The organic light emitting diode display device according to claim 1, wherein the discharge load includes a plurality of resistors connected in parallel, a first end of the plurality of resistors being connected to the display drive voltage and a second end of the plurality of resistors being coupled to the ground terminal through the first switch.

13. The organic light emitting diode display device according to claim 12, wherein, when a screen size of the display is a first size, a total resistance value of the discharge load is a first resistance value, and when the screen size of the display unit is a second size larger than the first size, the total resistance value of the discharge load is a second resistance value smaller than the first resistance value.

14. The organic light emitting diode display device according to claim 12, wherein, when a screen size of the display is a first size, the discharge load includes a first number of resistors, and when the screen size of the display is a second size larger than the first size, the discharge load includes a second number of resistors, the second number being larger than the first number.

15. The organic light emitting diode display device according to claim 1, wherein the first switch includes a field effect transistor (FET).

16. A method of operating an organic light emitting diode display device, the method comprising:

turning off power of the organic light emitting diode display device to stop supplying a display drive voltage to a display of the organic light emitting diode display device;

controlling, by a discharge control circuit included in the organic light emitting diode display device, a discharge circuit that is connected to the display of the organic light emitting diode display device to turn on; and discharging, by the discharge circuit, residual current from the display drive voltage applied to the display after the power is turned off, wherein the discharge circuit includes a discharge load connected to the display, and a first switch connected between the discharge load and a ground terminal, and wherein the first switch is turned off when the power of the organic light emitting diode display device is turned on, and the first switch is turned on when the power of the organic light emitting diode display device is turned off.

17. The method according to claim 16, wherein the discharge control circuit that includes:

a second switch having one end connected between a power supply unit included in the organic light emitting diode display device and the first switch, and another end connected to the ground terminal.

18. The method according to claim 17, wherein the controlling the discharge circuit to turn on includes:

turning off the second switch in the discharge control circuit when power of the organic light emitting diode display device is turned off;

applying, by the discharge control circuit, a discharge signal to the first switch in the discharge circuit in response to the second switch being turned off; and turning on the first switch in response to the applied discharge signal so that the discharge load is connected to the ground terminal.

19. The method according to claim 18, wherein the turning off the second switch includes:

not applying, by a controller of the organic light emitting diode display device, a drive signal that drives the display when the power is turned off; and turning off the second switch in the discharge control circuit to supply the discharge signal when the drive signal is not applied.

20. The method according to claim 16, further comprising:

turning on the power of the organic light emitting diode display device; and disabling, by the discharge control circuit, the discharge circuit when the power is turned on.

* * * * *